US009433304B2

(12) United States Patent
Mountz et al.

(10) Patent No.: US 9,433,304 B2
(45) Date of Patent: Sep. 6, 2016

(54) CHILD MOTION APPARATUS

(71) Applicant: Wonderland Nurserygoods Company Limited, Kwai Chung, N. T. (HK)

(72) Inventors: Jonathan K. Mountz, Birdsboro, PA (US); William B. Bellows, Wyomissing, PA (US); John T. Saint, Elverson, PA (US); John Sims, Narvon, PA (US); Peter R. Tuckey, Leola, PA (US)

(73) Assignee: Wonderland Nurserygoods Company Ltd., Hong Kong (HK)

( * ) Notice: Subject to any disclaimer, the term of this patent is extended or adjusted under 35 U.S.C. 154(b) by 0 days.

(21) Appl. No.: 14/640,156

(22) Filed: Mar. 6, 2015

(65) Prior Publication Data

US 2015/0250330 A1 Sep. 10, 2015

Related U.S. Application Data

(60) Provisional application No. 61/967,019, filed on Mar. 7, 2014, provisional application No. 61/998,088, filed on Jun. 17, 2014, provisional application No. 61/999,788, filed on Aug. 6, 2014.

(51) Int. Cl.

| | |
|---|---|
| ***A47D 13/10*** | (2006.01) |
| ***A63G 9/00*** | (2006.01) |
| ***A63G 9/12*** | (2006.01) |
| ***A63G 9/14*** | (2006.01) |
| ***A47D 9/02*** | (2006.01) |

(52) U.S. Cl.

CPC ..... *A47D 13/105* (2013.01); *A47D 9/02* (2013.01); *A47D 13/10* (2013.01)

(58) Field of Classification Search

CPC ..... A47D 13/10; A47D 13/105; A47D 9/02
USPC ..... 297/260.2, 274; 472/118, 119
See application file for complete search history.

(56) References Cited

U.S. PATENT DOCUMENTS

| | | | | |
|---|---|---|---|---|
| 4,516,806 | A * | 5/1985 | McDonald | A47D 13/02 297/183.2 |
| 4,762,364 | A * | 8/1988 | Young | B60N 2/2821 297/130 |
| 4,998,307 | A * | 3/1991 | Cone | B60N 2/2806 297/183.2 |
| 5,092,004 | A * | 3/1992 | Cone | B60N 2/2806 297/118 |
| 5,527,096 | A * | 6/1996 | Shimer | A47D 15/006 297/130 |
| 5,803,817 | A * | 9/1998 | Stern | A47D 13/105 472/118 |
| 6,027,409 | A * | 2/2000 | Favorito | A47D 13/105 472/118 |
| 6,196,629 | B1 * | 3/2001 | Onishi | B60N 2/2806 297/256.12 |
| 6,343,994 | B1 * | 2/2002 | Clarke | A47D 13/105 472/119 X |
| 6,679,552 | B1 * | 1/2004 | Kassai | B60N 2/2812 297/250.1 |
| 7,008,018 | B2 * | 3/2006 | Chen | A47D 1/008 297/361.1 |

(Continued)

OTHER PUBLICATIONS

Search Report for EP Appl. No. 15158038.8 dated Jun. 30, 2015.

*Primary Examiner* — Rodney B White
(74) *Attorney, Agent, or Firm* — Baker & McKenzie LLP

(57) ABSTRACT

A child motion apparatus includes a base, a seat arranged above the base, and an upright column disposed below the seat. The seat includes a bottom frame segment and a seatback frame segment, the bottom frame segment having a front and a rear end, the seatback frame segment being pivotally connected with the rear end of the bottom frame segment. The upright column pivotally supports the seat above the base, and is connected with the bottom frame segment at a location between the front end and the rear end thereof.

34 Claims, 25 Drawing Sheets

(56) References Cited

U.S. PATENT DOCUMENTS 7,364,235 B2 * 4/2008 Chen ..... A47D 1/002 297/148
7,722,118 B2 * 5/2010 Bapst ..... A47D 9/02 297/260.2 X
7,845,728 B2 * 12/2010 Chen ..... A47D 13/10 297/260.2 X
8,146,989 B2 * 4/2012 Godiska ..... A47D 9/02 181/145
8,197,005 B2 * 6/2012 Hopke ..... A47C 1/00 297/260.2
8,661,582 B2 * 3/2014 Sclare ..... A47D 9/02 472/118
8,746,794 B2 * 6/2014 Oren ..... A47D 11/005 297/274 X
8,834,282 B2 * 9/2014 Sclare ..... A47D 9/02 472/119
9,033,809 B2 * 5/2015 Haut ..... A47D 9/02 472/119
9,155,403 B2 * 10/2015 Mountz ..... A47D 13/105
2003/0020317 A1 * 1/2003 Keegan ..... A47D 13/107 297/446.2
2006/0270480 A1 * 11/2006 Chen ..... A47D 13/105 472/118
2007/0111809 A1 * 5/2007 Bellows ..... A47D 9/02 472/118
2007/0205646 A1 9/2007 Bapst et al.
2008/0098521 A1 5/2008 Westerkamp et al.
2008/0136236 A1 * 6/2008 Kincaid ..... A47D 9/02 297/260.2
2008/0238163 A1 * 10/2008 Bellows ..... A47D 9/02 297/274
2012/0052963 A1 * 3/2012 Teng ..... A63G 9/16 472/119
2012/0205954 A1 8/2012 Pollack et al.
2012/0264530 A1 * 10/2012 Gilbert ..... A63G 13/02 472/118
2013/0244802 A1 * 9/2013 Robbins ..... A47D 13/105 472/118
2014/0265490 A1 * 9/2014 Hopke ..... A47D 9/02 297/260.2
2014/0287846 A1 * 9/2014 Mountz ..... A47D 9/02 472/118
2015/0196137 A1 * 7/2015 Zhao ..... A47D 13/105 297/260.2
2015/0245719 A1 * 9/2015 Zhong ..... A47D 13/10 297/260.2

* cited by examiner

CHILD MOTION APPARATUS

CROSS-REFERENCE TO RELATED APPLICATION(S)

This patent application respectively claims priority to U.S. Provisional Patent Application No. 61/967,019 filed on Mar. 7, 2014; and to U.S. Provisional Patent Application No. 61/998,088 filed on Jun. 17, 2014, and to U.S. Provisional Patent Application No. 61/999,788 filed on Aug. 6, 2014, which are incorporated herein by reference.

BACKGROUND

1. Field of the Invention

The present invention relates to child motion apparatuses.

2. Description of the Related Art

Infant swing apparatuses have become common household items. An infant swing has the primary function of applying a gentle, swinging or gliding motion to soothe a child, while providing a safe and comfortable seating area. However, one main drawback of the current infant swings is that they are generally built with large standing frames and swing arms that are complicated to fold or disassemble. This makes travelling with an infant swing all the more difficult.

Therefore, there is a need for an apparatus for soothing a child that is more convenient in use, and can address at least the foregoing issues.

SUMMARY

The present application describes a child motion apparatus is conveniently collapsible, and can sway sideways to help soothing a child. In one embodiment, the child motion apparatus includes a base, a seat arranged above the base, and an upright column disposed below the seat. The seat includes a bottom frame segment and a seatback frame segment, the bottom frame segment having a front and a rear end, the seatback frame segment being pivotally connected with the rear end of the bottom frame segment. The upright column pivotally supports the seat above the base, and is connected with the bottom frame segment at a location between the front end and the rear end thereof.

In another embodiment, the child motion apparatus includes a base, a seat arranged above the base, an upright column pivotally supporting the seat above the base, the upright column defining a rotation axis that is inclined toward a rear of the seat, and a magnetic drive system operable to drive the seat to sway sideways about the rotation axis.

DETAILED DESCRIPTION OF THE EMBODIMENTS

Figure 1:
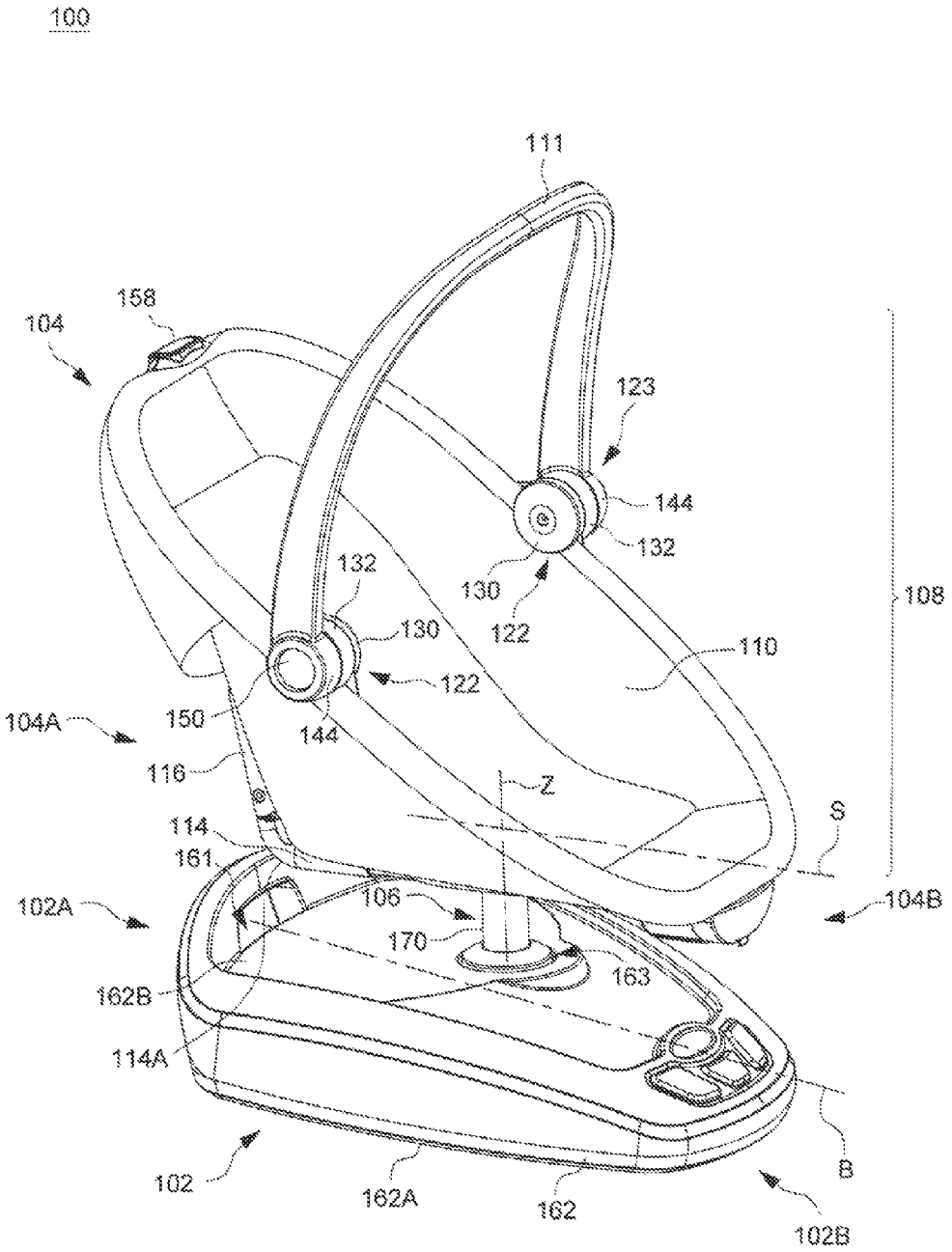
FIG. 1 is a perspective view illustrating an embodiment of a child motion apparatus.
Figure 2:
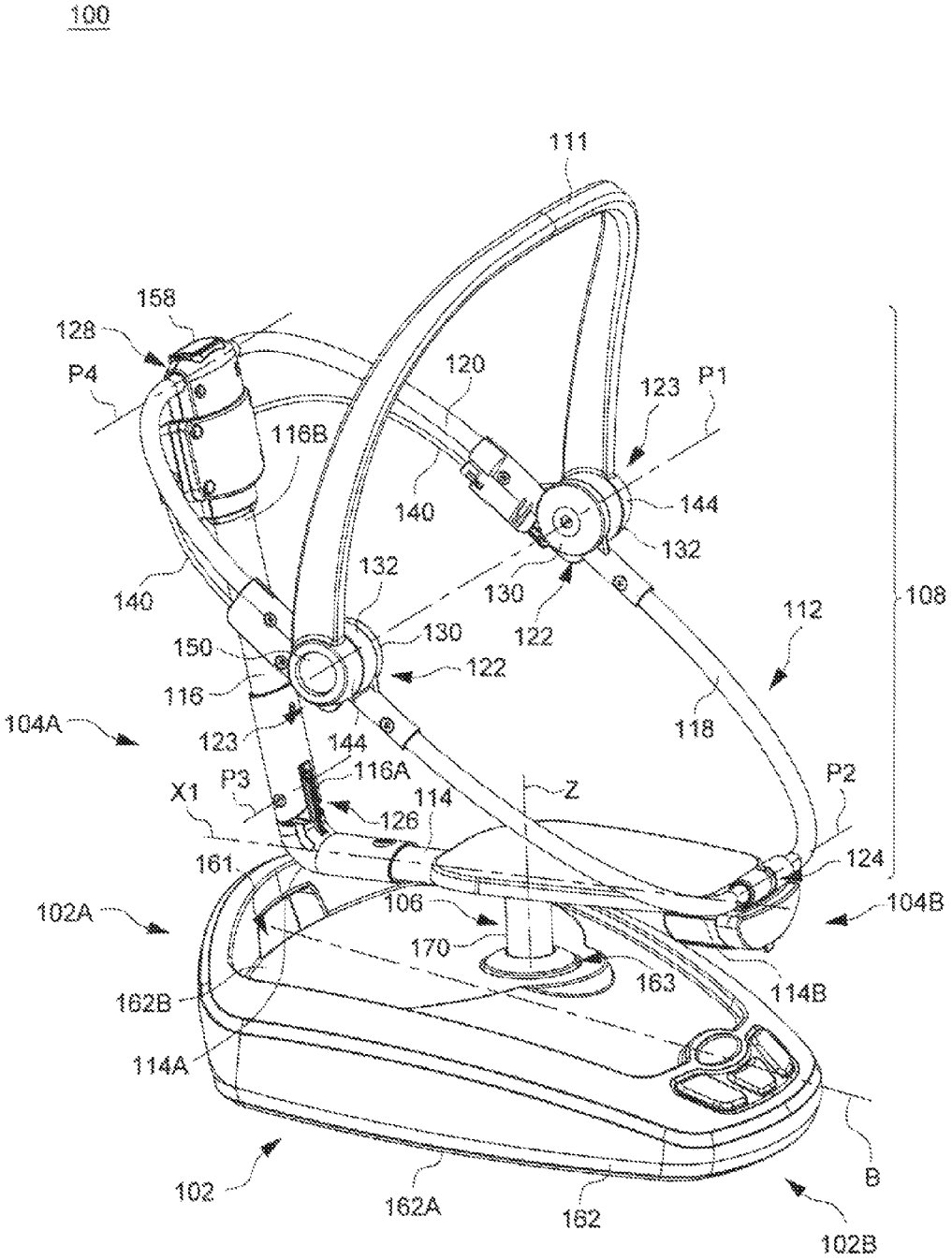
FIG. 2 is a perspective view illustrating a rigid frame of the child motion apparatus shown in FIG. 1.
Figure 3:
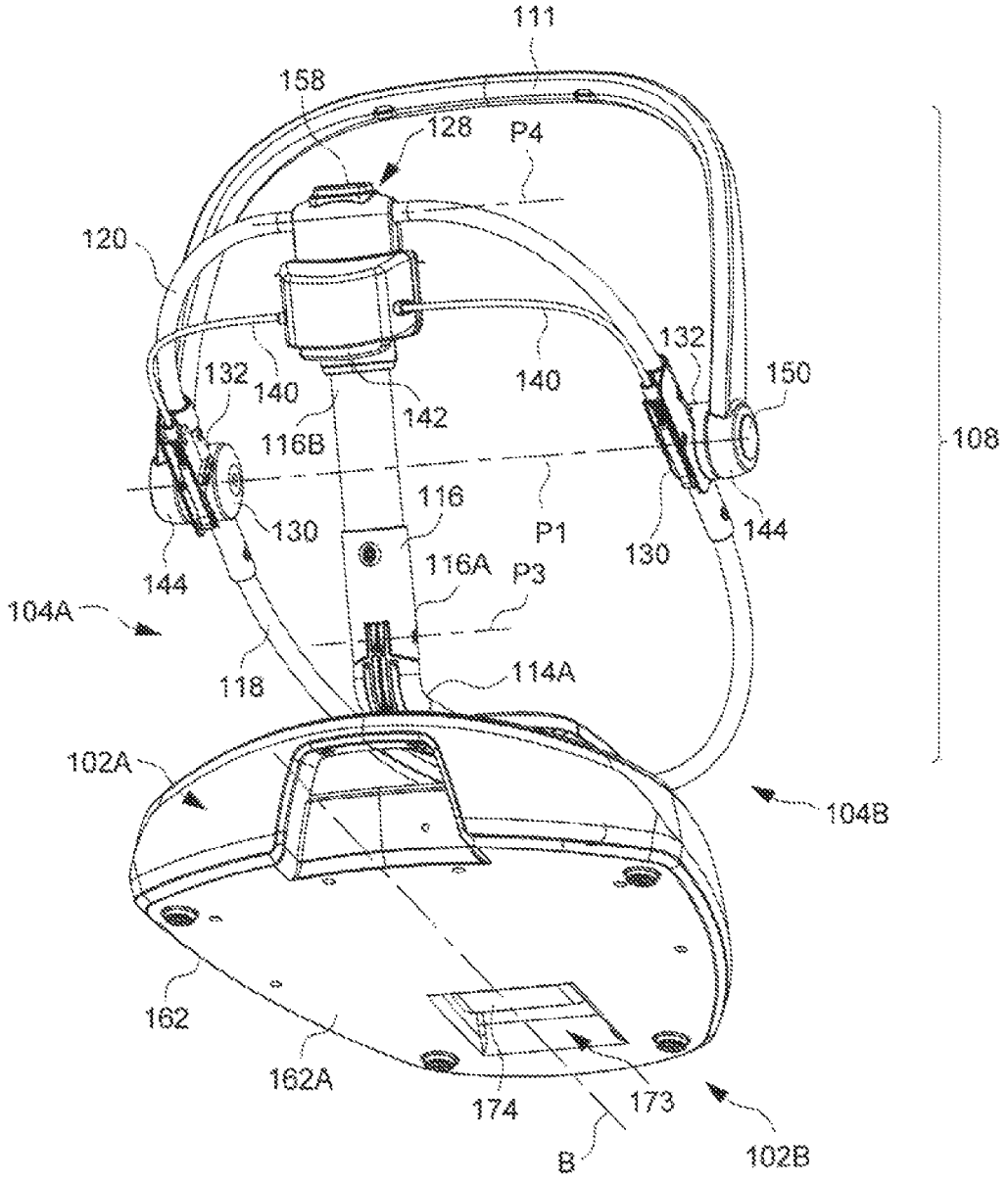
FIG. 3 is a schematic view illustrating the rigid frame of the child motion apparatus under another angle of view.

FIG. 1 is a schematic view illustrating an embodiment of a child motion apparatus 100, FIG. 2 is a schematic view illustrating a frame construction of the child motion apparatus 100, and FIG. 3 is a bottom perspective view of the child motion apparatus 100. The child motion apparatus 100 can include a support base 102, a seat 104 arranged above the base 102, and an upright column 106 disposed below the seat 104 and pivotally supporting the seat 104 above the base 102.

The seat 104 can have a rear 104A, a front 104B, and a longitudinal axis S extending centrally from the rear 104A to the front 104B. The seat 104 can include a rigid frame 108 (better shown in FIG. 2), a fabric material 110 secured with the rigid frame 108 to define a sitting area for receiving a child, and a carrying handle 111 connected with the rigid frame 108. As shown in FIG. 2, the rigid frame 108 can include a surrounding frame 112 to which is fixedly connected the fabric material 110, a bottom frame segment 114 and a seatback frame segment 116.

The surrounding frame 112 can surround a region where the fabric material 110 can be stretched to form a seating support for receiving a child. The surrounding frame 112 can include two surrounding frame portions 118 and 120 that are pivotally connected with each other via two pivot hinges 122 defining a same pivot axis P1. Each of the two surrounding frame portions 118 and 120 can exemplary have a semi-oval shape. When the child motion apparatus 100 is deployed, the surrounding frame portion 118 can extend downward from the pivot axis P1, and the surrounding frame portion 120 can extend upward from the pivot axis P1. The two pivot hinges 122 can respectively connect the two surrounding frame portions 118 and 120 at a left and a right side thereof. The carrying handle 111 can have an arc shape having two sides respectively connected pivotally with the surrounding frame 112 about the pivot axis P1 via two pivot hinges 123.

The bottom frame segment 114 can have a generally elongated shape, and can extend along a longitudinal axis X1 that lies centrally relative to the seat 104 and extends from the rear 104A to the front 104B of the seat 104. The bottom frame segment 114 can have a rear and a front end 114A and 114B respectively corresponding to the rear and front 104A and 104B of the seat 104. The seatback frame segment 116 can have a generally elongated shape, and can be disposed behind the portion of the fabric material 110 that forms the seat support, i.e., generally behind a back of a child received in the seat 104. The seatback frame segment 116 can rise upward from the bottom frame segment 114, and has a lower end 116A and an upper end 116B. The front end 114B of the bottom frame segment 114 can be pivotally connected with a lower region of the surrounding frame portion 118 via a pivot hinge 124 defining a pivot axis P2. The rear end 114A of the bottom frame segment 114 can be pivotally connected with the lower end 116A of the seatback frame segment 116 via a pivot hinge 126 defining a pivot axis P3. The upper end 116B of the seatback frame segment 116 can be pivotally connected with a top of the surrounding frame portion 120 via a pivot hinge 128 defining a pivot axis P4. The pivot axes P1, P2, P3 and P4 are parallel to one another and extend transversally relative to the seat 104 (i.e., from a left to a right side thereof).

In conjunction with FIGS. 1-3, FIGS. 7 and 8 are schematic views illustrating the construction of the pivot hinge 122 that is respectively arranged at each of the left and right side of the seat 104 and pivotally connects the surrounding frame portions 118 and 120. The pivot hinge 122 can include two coupling shells 130 and 132 that enclose an inner cavity in which are respectively assembled a latching member 134, a spring 136 and a release actuator 138. The coupling shell 130 can be affixed with an end of the surrounding frame portion 118, and the coupling shell 132 can be affixed with an end of the surrounding frame portion 120. The coupling shell 130 can be pivotally connected with a first side of the coupling shell 132 about the pivot axis P1. Each of the coupling shells 130 and 132 can respectively have a circular shape, and the coupling shell 130 and the first side of the coupling shell 132 can be internally provided with a plurality of teeth, i.e., teeth 130A for the coupling shell 130, and teeth 132A for the coupling shell 132.

The latching member 134 can have a circular shape provided with a plurality of teeth 134A. The latching member 134 can be arranged for sliding displacement along the pivot axis P1 between a locking state where the teeth 134A of the latching member 134 respectively engage with the teeth 130A and 132A to lock the surrounding frame 112 in an unfolded state, and an unlocking state where the teeth 134A of the latching member 134 disengage from the teeth 132A to allow folding rotation of the surrounding frame portion 118 about the pivot axis P1 relative to the surrounding frame portion 120.

The spring 136 can be respectively connected with the latching member 134 and an inner sidewall of the coupling shell 130. The spring 136 can bias the latching member 134 to the locking state for holding the surrounding frame portions 118 and 120 in the unfolded or deployed state.

The release actuator 138 can be pivotally connected about the pivot axis P1, and can have one or more ramp surfaces 138A in sliding contact with the latching member 134. The release actuator 138 can be rotatable about the pivot axis P1 so that the ramp surfaces 138A can push the latching member 134 to slide along the pivot axis P1 against the biasing action of the spring 136 to the unlocking state for allowing folding rotation of the surrounding frame portion 118 relative to the surrounding frame portion 120.

Referring again to FIGS. 1-3, 7 and 8, the release actuator 138 can be further connected with a cable assembly 140 at a location eccentric from the pivot axis P1, and the cable assembly 140 in turn is connected with a release button 142 (better shown in FIG. 3) provided on the seatback frame segment 116 near the upper end 116B thereof. When the release button 142 is depressed, the cable assembly 140 can be pulled to drive unlocking rotation of the release actuator 138, which in turn pushes the latching member 134 to slide along the pivot axis P1 to the unlocking state for allowing folding rotation of the surrounding frame portion 118 relative to the surrounding frame portion 120. Since the release button 142 is likewise connected with the two cable assemblies 140 at the left and right sides, the operation of the release button 142 can concurrently unlock the two pivot hinges 122.

In conjunction with FIGS. 1-3, FIG. 9 is a schematic view illustrating the construction of the pivot hinge 123 that is respectively arranged at each of the left and right side of the carrying handle 111 and pivotally connects the carrying handle 111 with the surrounding frame 112. The pivot hinge 123 can include the coupling shell 132, another coupling shell 144 affixed with an end of the carrying handle 111, a latching member 146, a spring 148 and a release button 150. The coupling shell 144 can be pivotally connected with a second side of the coupling shell 132 (i.e., opposite to that of the coupling shell 130) about the pivot axis P1, the coupling shell 132 being thereby sandwiched between the coupling shells 130 and 144. The coupling shells 132 and 144 can enclose an inner cavity in which are respectively assembled the latching member 146 and the spring 148. The coupling shell 144 and the second side of the coupling shell 132 can be respectively provided with a plurality of inner teeth, i.e., the teeth 132B for the coupling shell 132, and the teeth 144A (shown with phantom lines in FIG. 9) for the coupling shell 144.

The latching member 146 can have a circular shape provided with a plurality of teeth 146A. The latching member 146 can be arranged for sliding displacement along the pivot axis P1 between a locking state where the teeth 146A of the latching member 146 respectively engage with the teeth 132B and 144A of the two coupling shells 132 and 144 to lock the carrying handle 111 with the surrounding frame 112, and an unlocking state where the teeth 146A of the latching member 146 disengage from the teeth 144A of the coupling shell 144 to allow rotation of the carrying handle 111 about the pivot axis P1 relative to the surrounding frame 112. The spring 148 can be respectively connected with the latching member 146 and an inner sidewall of the coupling shell 132, and can bias the latching member 146 to the locking state.

The release button 150 can be affixed with the latching member 146, and can be exposed outward on the coupling shell 144. The release button 150 can be depressed to push the latching member 146 to slide along the pivot axis P1 against the biasing action of the spring 148 to the unlocking state for allowing pivotal adjustment of the carrying handle 111.

Figure 10:
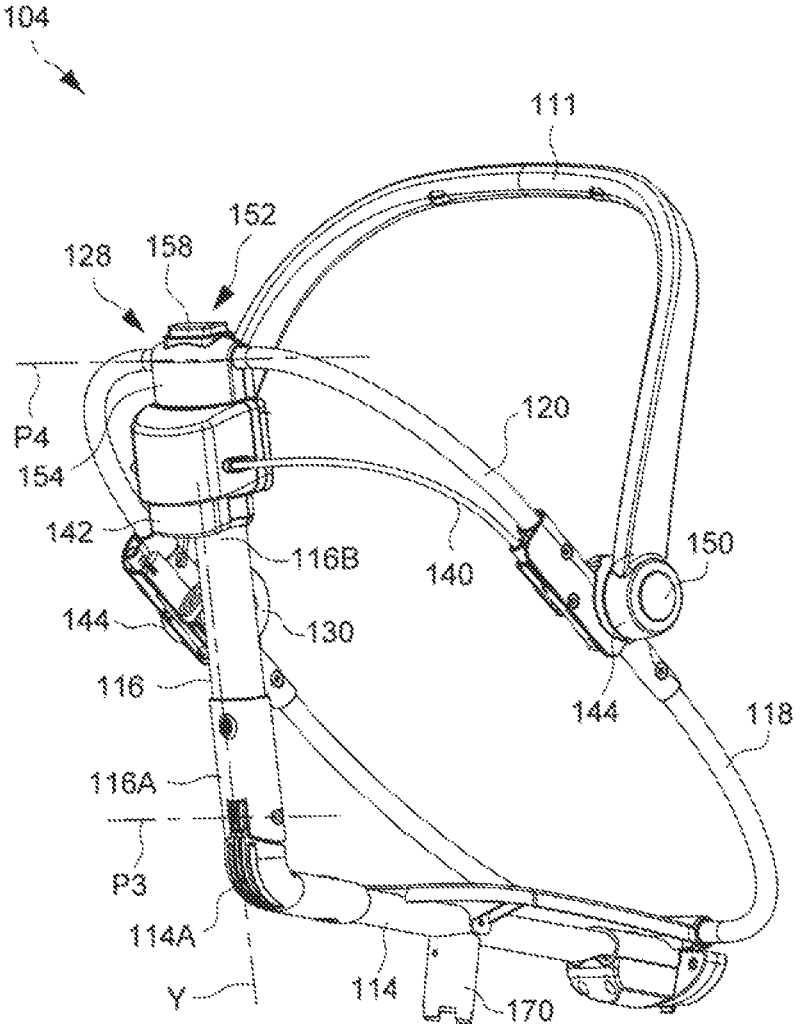
FIG. 10 is a schematic view illustrating a seat portion of the child motion apparatus.
Figure 11:
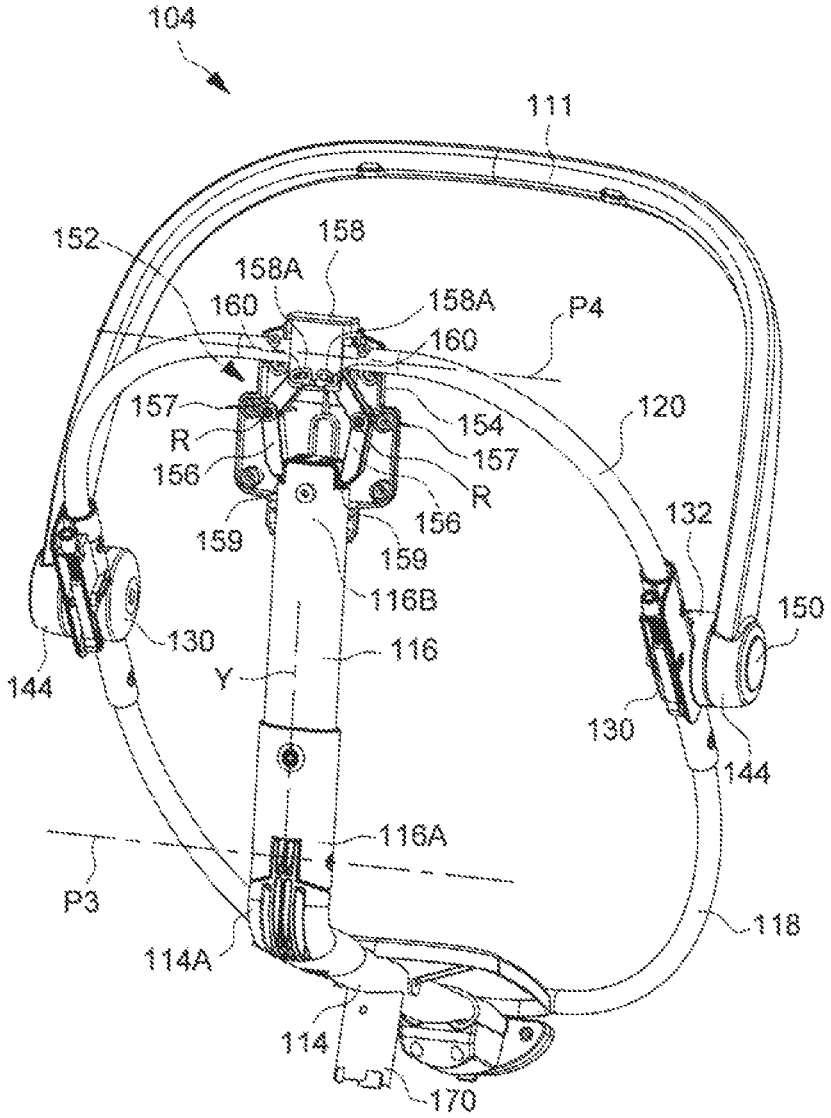
FIG. 11 is a schematic view illustrating a recline adjustment mechanism implemented in the seat portion of the child motion apparatus.

In conjunction with FIGS. 1-3, FIGS. 10-15 are schematic views illustrating a recline adjustment mechanism 152 operable to modify an inclination angle of the seatback frame segment 116 relative to the bottom frame segment 114 in the seat 104. For clarity, some parts of the seat 104 (e.g., cable assembly 140 and fabric material 110) are omitted in the representation of FIGS. 11-13. Referring to FIGS. 10 and 11, the recline adjustment mechanism 152 can be arranged adjacent to the pivot hinge 128. The pivot hinge 128 can include a housing 154 that is pivotally connected with the surrounding frame portion 120 and slidably connected with the upper end 116B of the seatback frame segment 116. The recline adjustment mechanism 152 can include the housing 154, two latches 156, two springs 157 and a release button 158. The seatback frame segment 116 can have a generally linear shape extending along a lengthwise axis Y, and the upper end 116B thereof can be assembled for sliding movement through an interior of the housing 154 along the lengthwise axis Y. Moreover, the upper end 116B of the seatback frame segment 116 can be formed with two notches 159. The two latches 156 can be respectively connected pivotally with the housing 154 about two pivot axes R that are perpendicular to the lengthwise axis Y. The two latches 156 can respectively rotate relative to the housing 154 toward the seatback frame segment 116 to engage with the two notches 159, and away from the seatback frame segment 116 to disengage from the two notches 159. The two springs 157 can be torsion springs respectively connected with the two latches 156. The springs 157 can respectively bias the two latches 156 to engage with the two notches 159.

The release button 158 can be assembled for sliding relative to the housing 154, and can be connected with the two latches 156. More specifically, each of the two latches 156 can have a pin 160 that can be slidably guided along a corresponding slot 158A formed in the release button 158. For convenient operation, the release button 158 can be exemplary placed near the top of the surrounding frame 112 and above the release button 142. When the release button 158 is depressed, the two latches 156 can be driven in rotation to respectively disengage from the two notches 159.

Referring to FIG. 11, when the two latches 156 are respectively engaged with the two notches 159 by the biasing action of the springs 157, upward sliding displacement of the seatback frame segment 116 relative to the housing 154 is prevented, and the seatback frame segment 116 can be thereby locked at a first angular position relative to the bottom frame segment 114. This first angular position of the seatback frame segment 116 is exemplary shown in FIG. 14.

Figure 12:
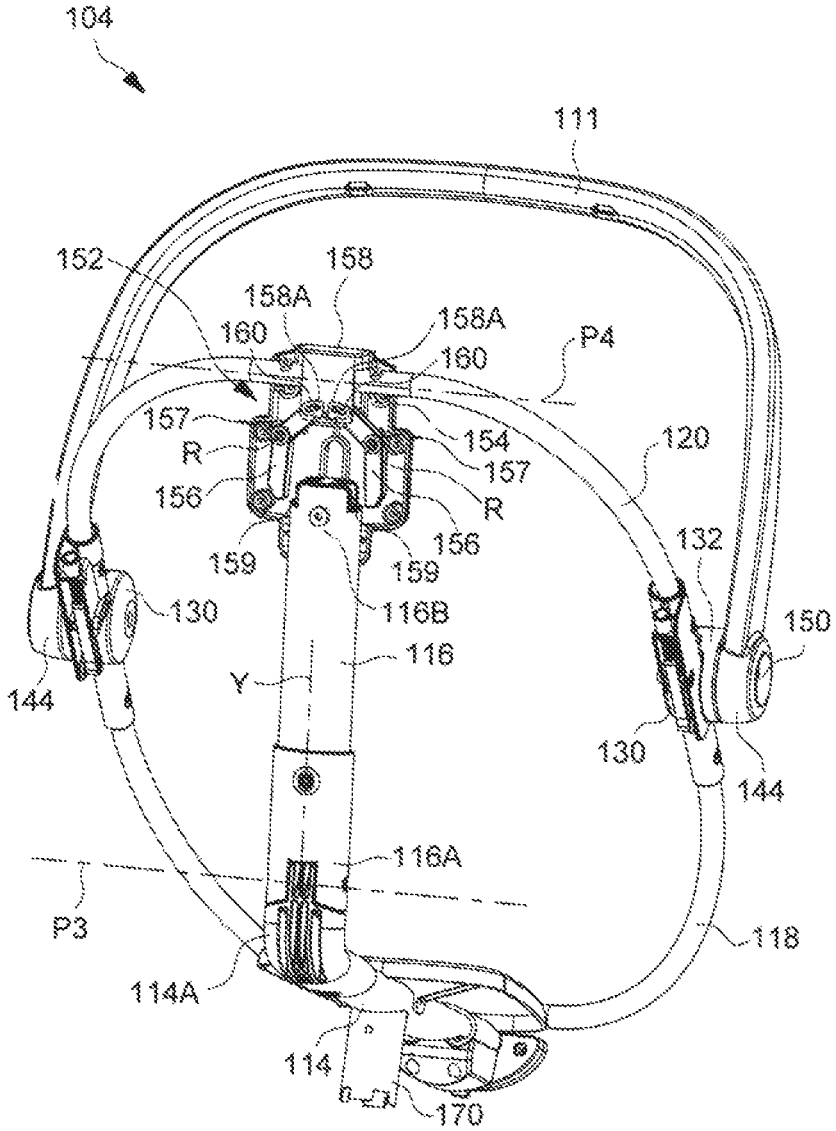
FIG. 12 is a schematic view illustrating latches of the recline adjustment mechanism in an unlocking state.
Figure 13:
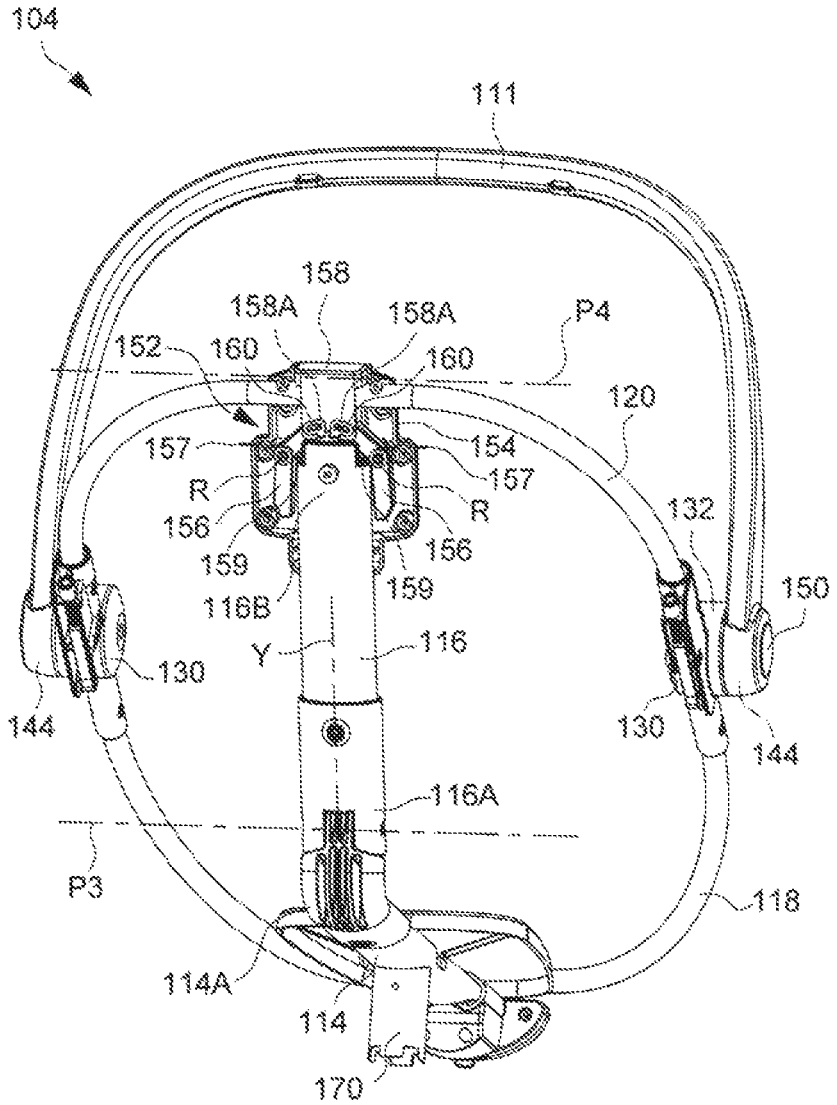
FIG. 13 is a schematic view illustrating exemplary operation of the recline adjustment mechanism.
Figure 14:
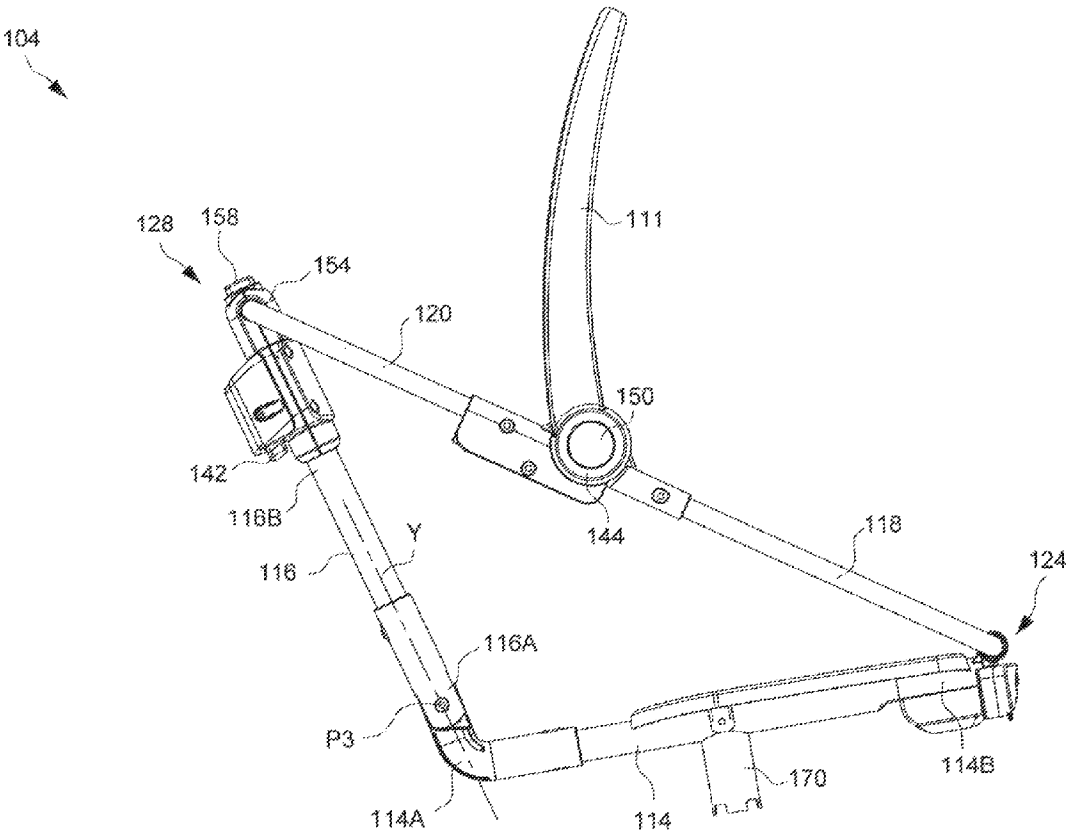
FIG. 14 is a schematic view illustrating a seatback frame segment of the seat in a first position.
Figure 15:
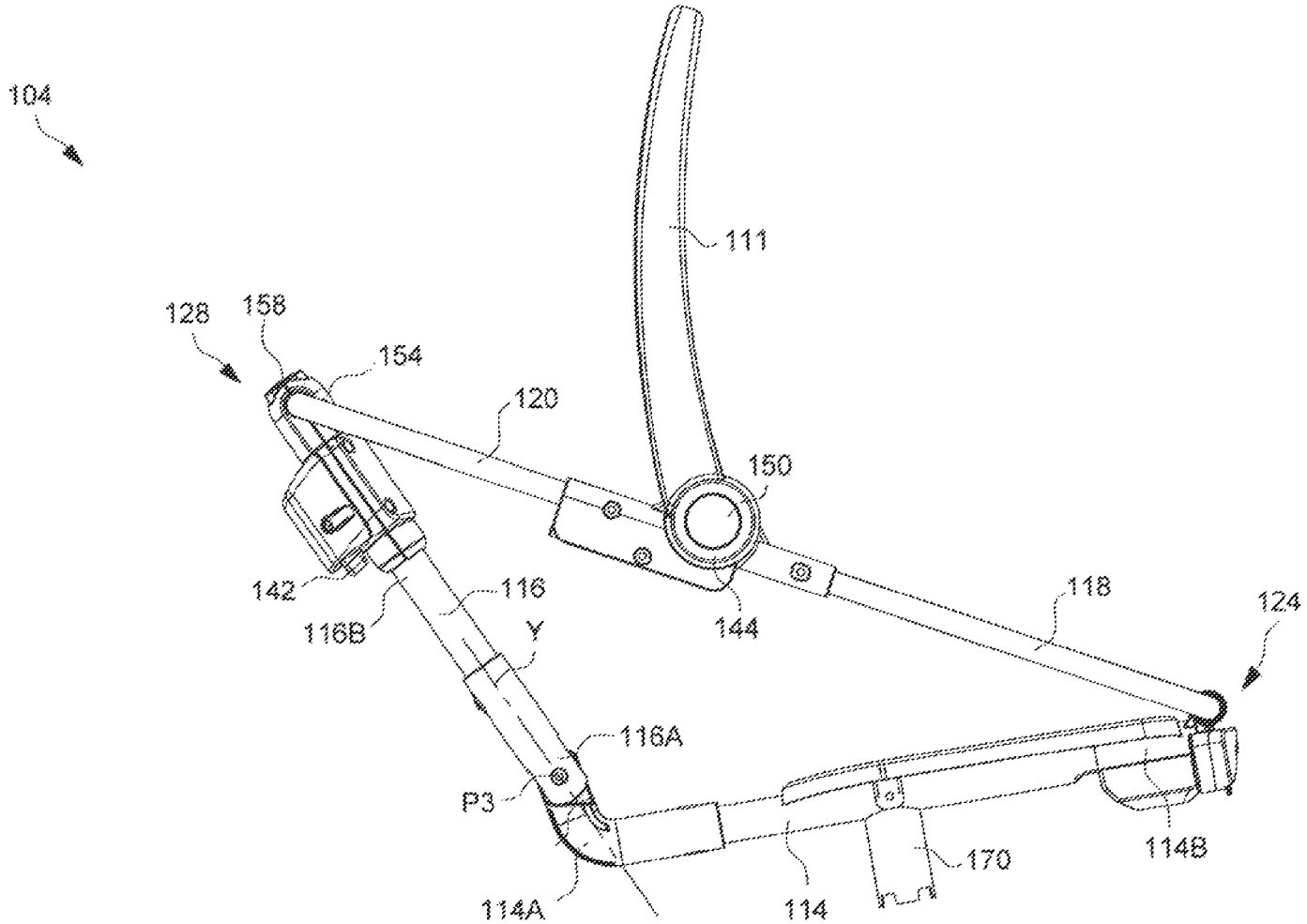
FIG. 15 is a schematic view illustrating the seatback frame segment of the seat in a second position reclined from the first position.

Referring to FIGS. 12 and 13, when the release button 158 is depressed, the two latches 156 can respectively disengage from the two notches 159, and the seatback frame segment 116 can be rotated about the pivot axis P3 relative to the bottom frame segment 114 to a recline or second angular position. This causes upward sliding displacement of the seatback frame segment 116 relative to the housing 154 (as better shown in FIG. 13) as well as rotation of the housing 154 about the pivot axis P4 relative to the surrounding frame 112. The recline or second angular position of the seatback frame segment 116 relative to the bottom frame segment 114 is exemplary shown in FIG. 15.

Referring again to FIGS. 1-3, the seat 104 can be pivotally supported on the upright column 106, which is upwardly connected with the bottom frame segment 114 at a location between the rear end 114A and the front end 114B thereof. The upright column 106 defines a rotation axis Z about which the seat 104 can rotate sideways to a left and a right side. The rotation axis Z of the upright column 106 can be substantially adjacent to the longitudinal axis S of the seat 104. Moreover, the rotation axis Z can be inclined toward a rear of the seat 104 by an angle T (better shown in FIG. 18) relative to a vertical direction, such that the seat 104 is inclined rearward. In one embodiment, the rearward inclination angle of the rotation axis Z relative to a vertical direction can be between about 0 and about 15 degrees, and more preferably about 10 degrees. Accordingly, the sideways swaying motion performed by the seat 104 can also have a vertical component in addition to a horizontal component, which can make use of gravity action to help maintaining the oscillating movement of the seat 104.

In conjunction with FIGS. 1-3, FIGS. 4-6 are schematic views illustrating an inner construction of the base 102. Referring to FIGS. 1-6, the base 102 can have a rear 102A, a front 102B, and a longitudinal axis B extending centrally from the rear 102A to the front 102B and lying substantially adjacent to the rotation axis Z of the upright column 106. The base 102 can include a shell body 162 in which are arranged a base frame 164 and an adjustable frame 166. The shell body 162 can have a bottom surface 162A and an upper surface 162B. The bottom surface 162A can provide a stable resting support on a floor surface. The upper surface 162B has an opening 163 through which the upright column 106 is arranged. Moreover, a rear portion of the shell body 162 may form a handle 161 for facilitating grasping of the child motion apparatus 100 with a hand. For clarity of illustration, the bottom surface 162A of the shell body 162 is not represented in FIG. 4, and the upper surface 162B of the shell body 162 is not represented in FIG. 5.

Figure 4:
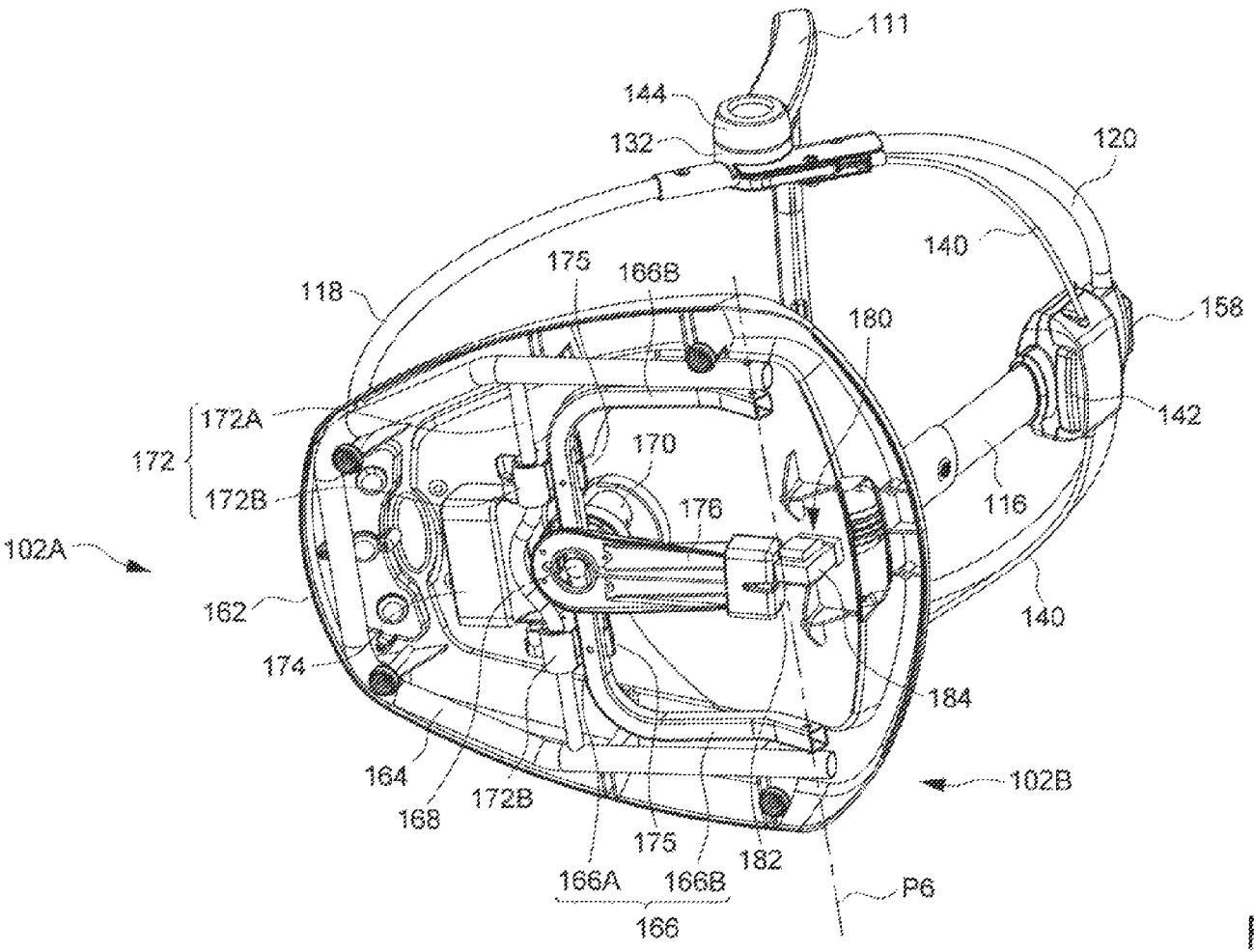
FIG. 4 is a schematic view illustrating the interior of a base in the child motion apparatus shown in FIG. 1.
Figure 5:
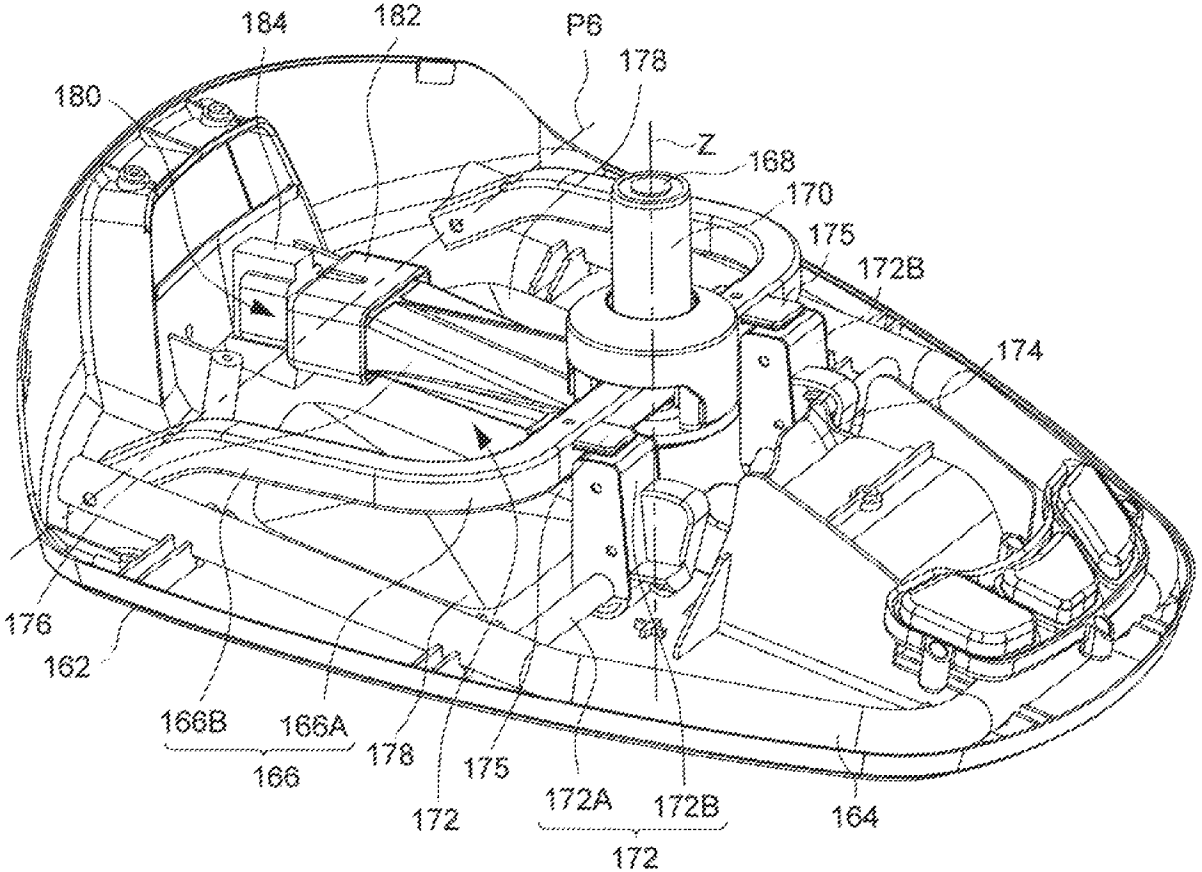
FIG. 5 is another schematic view illustrating the interior of the base in the child motion apparatus.
Figure 6:
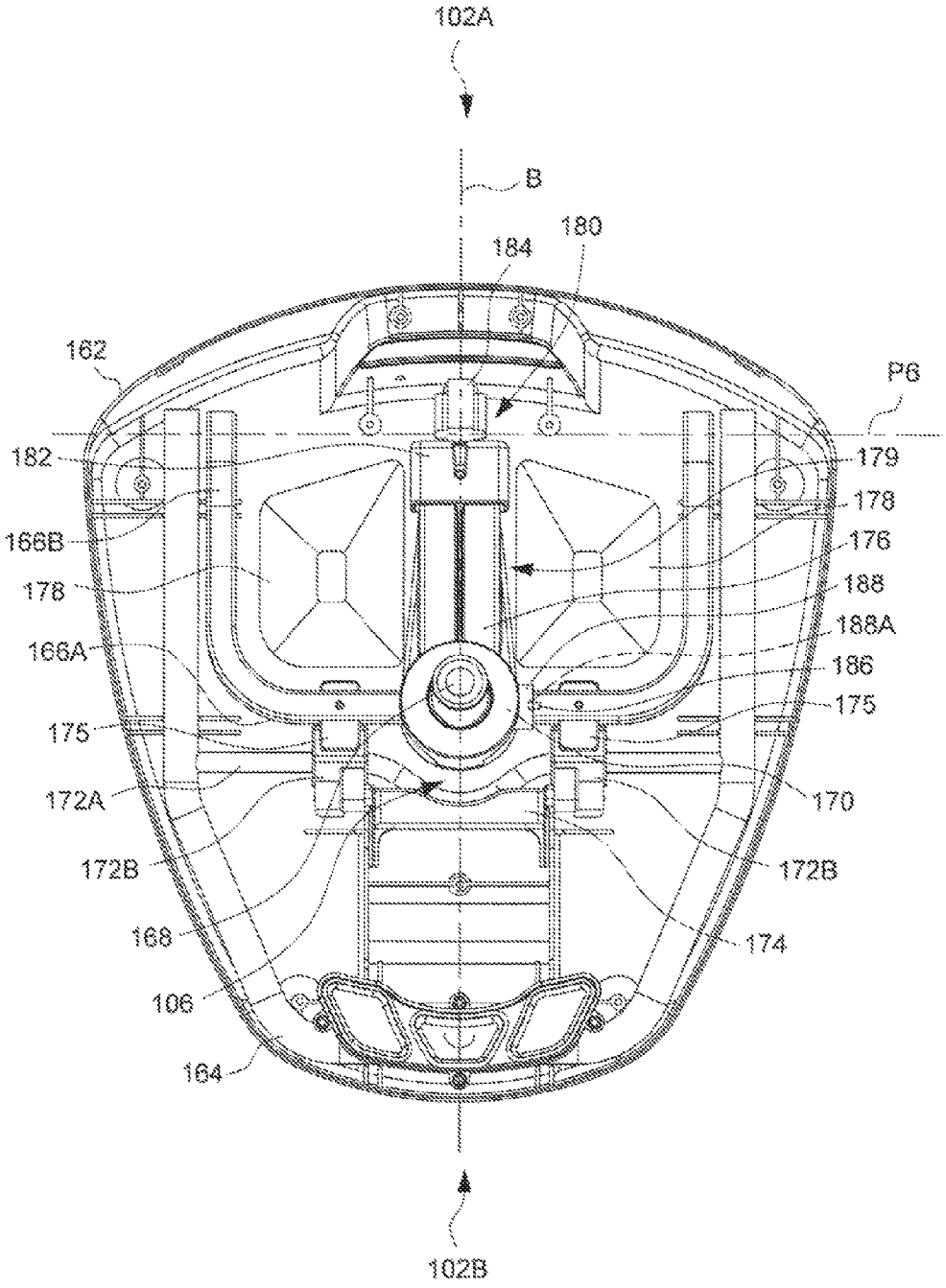
FIG. 6 is a schematic top view illustrating the interior of the base in the child motion apparatus.
Figure 7:
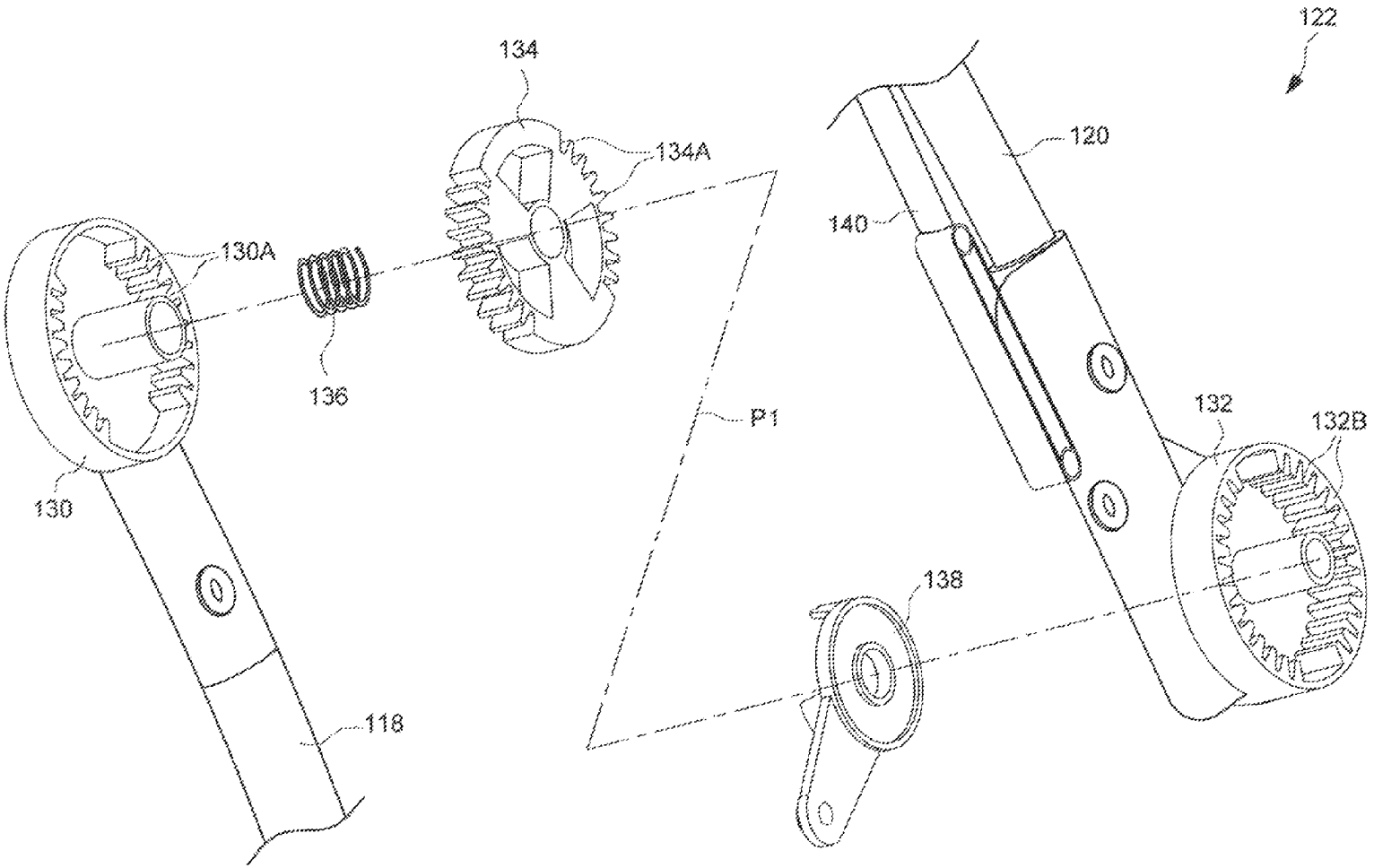
FIG. 7 is a schematic view illustrating the construction of a pivot hinge connecting a surrounding frame in the child motion apparatus.
Figure 8:
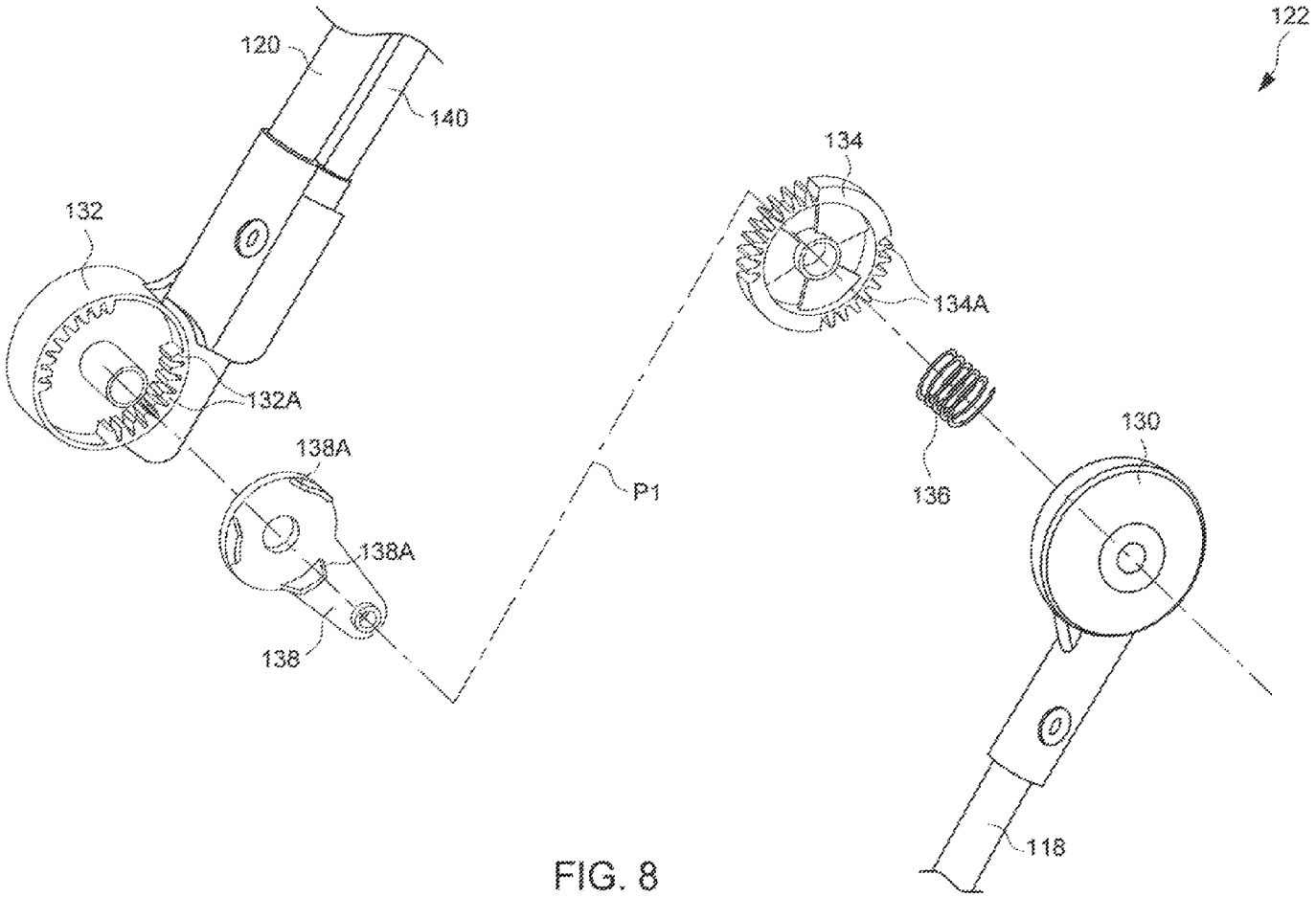
FIG. 8 is a schematic view illustrating the pivot hinge shown in FIG. 7 under an opposite angle of view.
Figure 9:
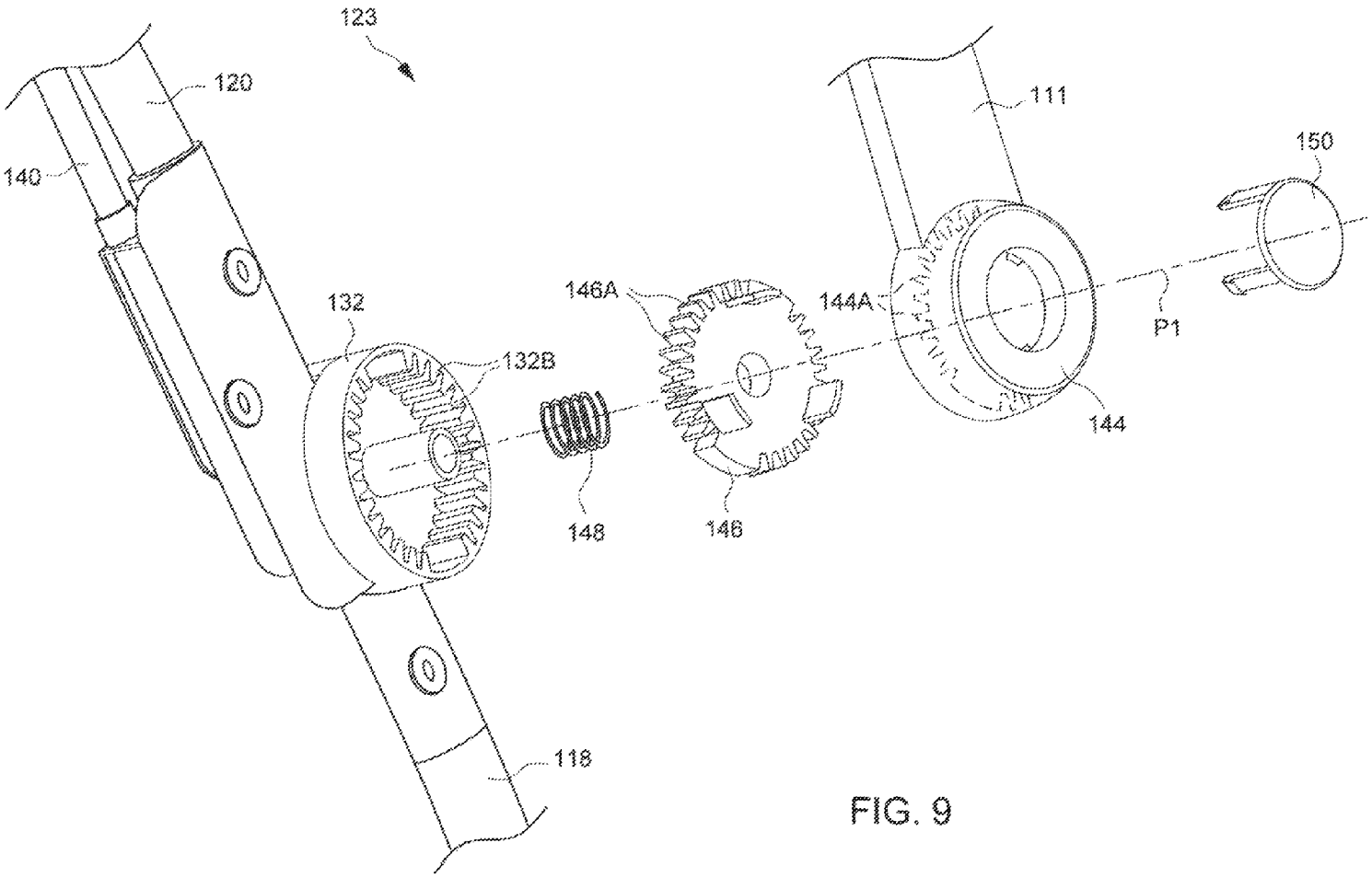
FIG. 9 is a schematic view illustrating another pivot hinge used to connect a carrying handle with the surrounding frame in the child motion apparatus.

Referring to FIGS. 4-6, the base frame 164 can be affixed in the shell body 162 below the upper surface 162B, and can be formed by a tubular assembly extending from a rear to a front of the shell body 162. The base frame 164 can form a reinforcing structure for the base 102.

The adjustable frame 166 can be arranged in an interior of the shell body 162, and can be movably connected to the base frame 164 for up and down displacement below the upper surface 162B of the shell body 162. In one embodiment, the adjustable frame 166 can be pivotally connected with the base frame 164 about a pivot axis P6 near the rear 102A of the base 102. The adjustable frame 166 may be constructed as a unitary block of a generally U-shape including a transversal segment 166A and two side segments 166B. The two side segments 166B can be respectively connected with a left and a right side of the transversal segment 166A, and can have respective distal ends pivotally connected with the base frame 164 about the pivot axis P6. While the adjustable frame 136 is shown as having a specific shape, it will be understood that the adjustable frame 136 may also be formed with any shapes in general.

Referring to FIGS. 1-5, the upright column 106 can be connected with the adjustable frame 166. In one embodiment, the upright column 106 can include a shaft 168 affixed with the adjustable frame 166, and a sleeve 170 affixed with the seat 104. The shaft 168 can be fixedly connected to a central region of the transversal segment 166A, and can define the rotation axis Z of the seat 104. The sleeve 170 can be affixed with the bottom frame segment 114 at a location between the rear end 114A and the front end 114B thereof. The shaft 168 can be assembled through an interior of the sleeve 170, such that the sleeve 170 and the seat 104 are rotatable about the rotation axis Z relative to the shaft 168 and the adjustable frame 166 of the base 102.

As the upright column 106 and the seat 104 are displaced vertically between an upper and a lower position, the adjustable frame 166 can be rotatable about the pivot axis P6 relative to the shell body 162 and the base frame 164. More specifically, when the adjustable frame 166 is in a raised position, the upright column 106 and the seat 104 can be held in an upper position above the upper surface 162B of the shell body 162 where the seat 104 can be deployed and sway sideways. While the adjustable frame 166 is rotated from the raised position to a downward position, the upright column 106 and the seat 104 is displaced toward the upper surface 162B to a lower position (better shown in FIG. 21) that facilitates collapse and storage of the seat 104 and prevents rotation of the seat 104.

Referring to FIGS. 3-6, the base 102 can further include an abuttal member 172 and a release actuator 174 connected with each other. The abuttal member 172 can be assembled in the base 102. In the illustrated embodiment, the abuttal member 172 exemplary includes two spaced-apart posts 172B that are pivotally supported by a shaft 172A. The shaft 172A extends transversally relative to the shell body 162 and is affixed with the base frame 164, and the two posts 172B extend radially relative to the shaft 172A and can rotate relative to the shaft 172A. The abuttal member 172 can be exemplary placed near the transversal segment 166A of the adjustable frame 166. The posts 172B of the abuttal member 172 can engage with an underside of tongues 175 protruding from the transversal segment 166A to bear the adjustable frame 166 in the raised position, and thereby support the upright column 106 and the seat 104 in the upper position. The abuttal member 172 can further pivot relative to the shell body 162 and the adjustable frame 166 to disengage the posts 172B from the tongues 175 of the transversal segment 166A, thereby allowing a downward rotation of the adjustable frame 166 to the downward position for collapsing the seat 104.

The release actuator 174 is connected with the posts 172B of the abuttal member 172, and can be accessible for operation at an underside of the base 102. For example, the bottom surface 162A of the shell body 162 can have an opening 173 (better shown in FIG. 3) through which the release actuator 174 can be exposed for operation. The release actuator 174 can be manually operated to cause rotation of the abuttal member 172 for disengaging from the adjustable frame 166, thereby allowing displacement of the adjustable frame 166 to the aforementioned downward position for collapsing the child motion apparatus 100. The placement of the release actuator 174 at the underside of the base 102 can prevent inadvertent operation of the release actuator 174 that would cause accidental collapse of the child motion apparatus 100.

Referring to FIGS. 4-6, the seat 104 can be further affixed with a bar segment 176. For example, the bar segment 176 can be disposed in the shell body 162 between the two side segments 166B of the adjustable frame 166, and can be affixed with the sleeve 170 adjacent to the rotation axis Z. The bar segment 176 can extend centrally with respect to the seat 104 (i.e., substantially aligned with the longitudinal axis S of the seat 104 shown in FIG. 1) and along a radial direction from the upright column 106 toward the rear 104A of the seat 104. As the bar segment 176 is affixed with the seat 104, the bar segment 176 and the seat 104 can also be movable vertically between the upper and lower position along with the adjustable frame 166 as described previously. The interior of the shell body 162 can further include two ramp structures 178 that respectively protrude upward and are disposed symmetrically at two sides of the longitudinal axis B of the base 102. The two ramp structures 178 can be exemplary affixed with the shell body 162, and a space 179 can be defined between the ramp structures 178. The two ramp structures 178 can act as a retaining mechanism capable of capturing and locking the seat 104 in a centered position relative to the base 102 (i.e., the two longitudinal axes S and B are vertically aligned with each other).

Figure 16:
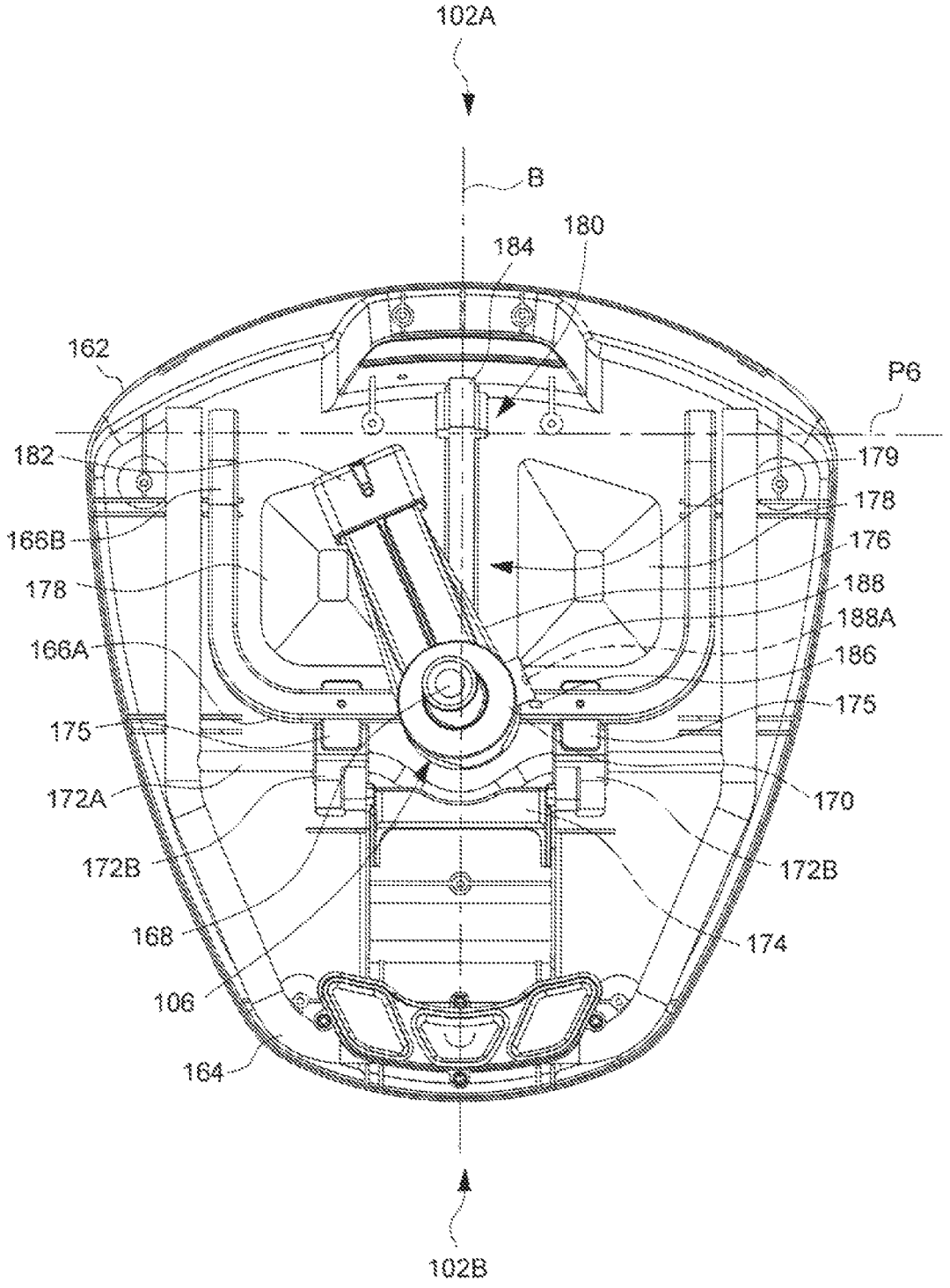
FIGS. 16 and 17 are schematic views illustrating exemplary operation of ramp structures provided in the base of the child motion apparatus.
Figure 17:
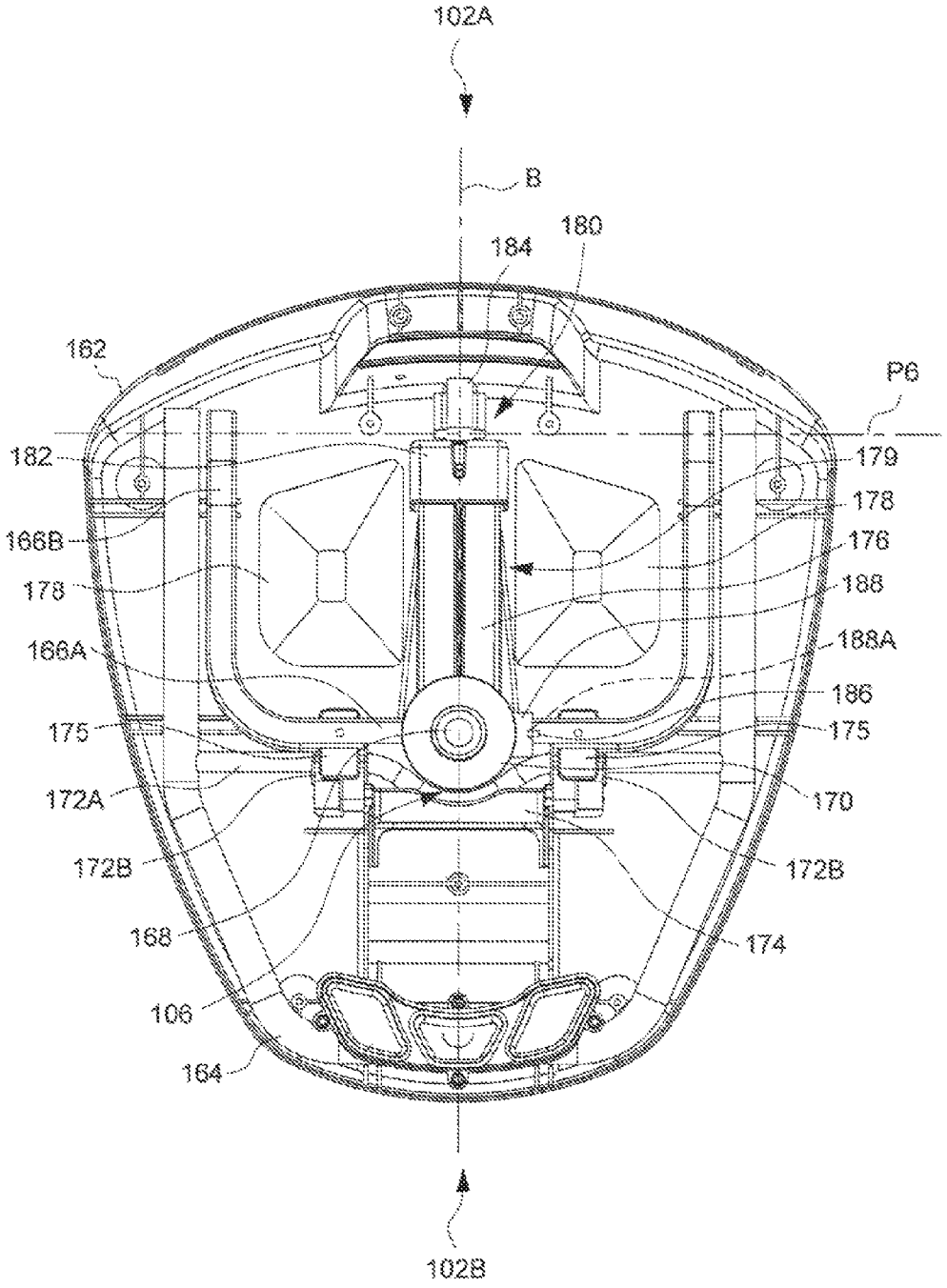
Figure 18:
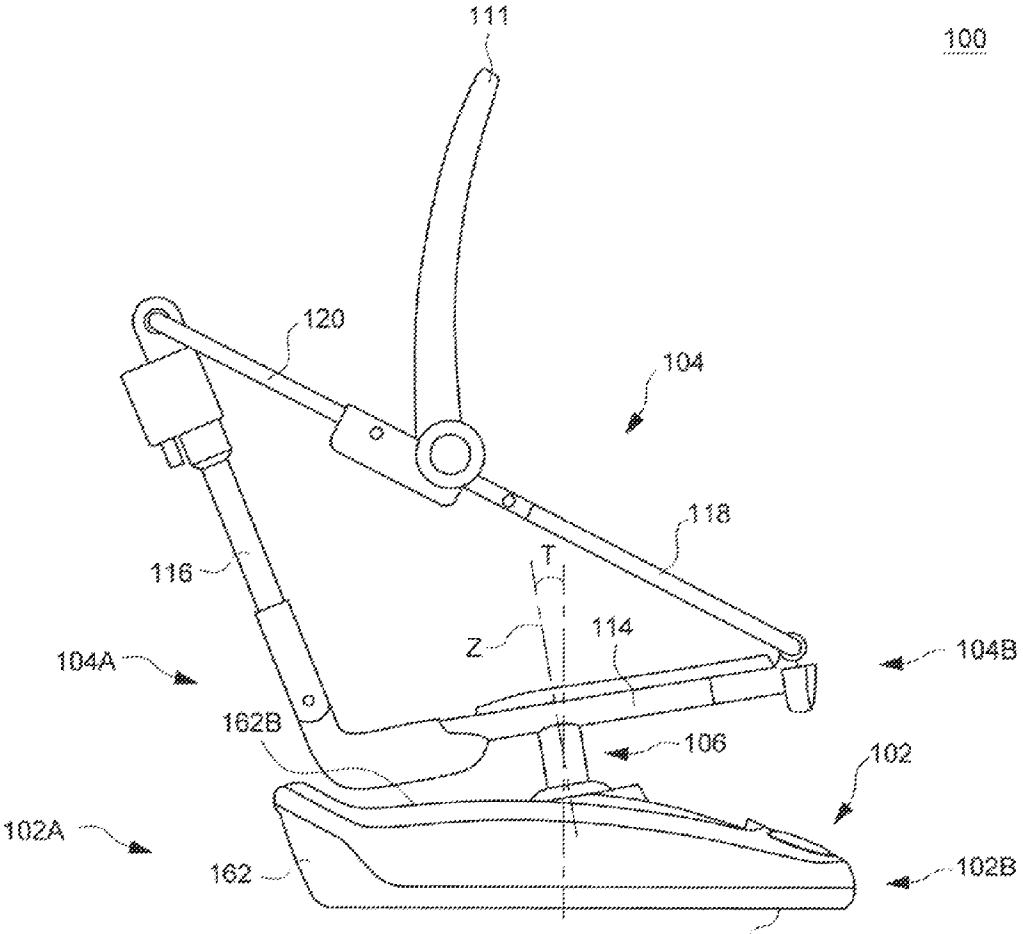
FIG. 18 is a side view illustrating the child motion apparatus in a deployed state.
Figure 21:
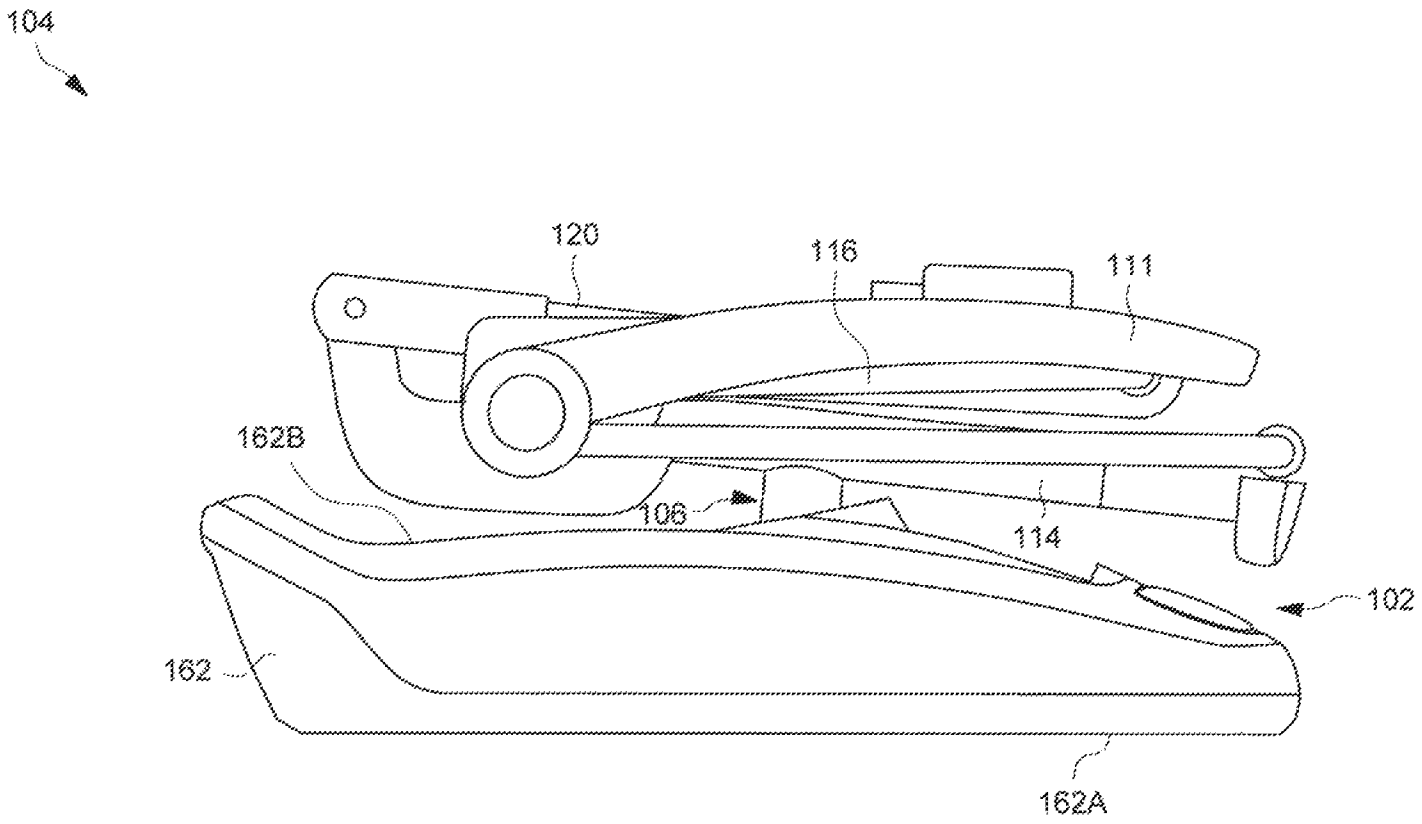

In conjunction with FIGS. 5 and 6, FIGS. 16 and 17 are schematic views illustrating exemplary operation of the ramp structures 178 when the seat 104 is collapsed downward, and FIGS. 18 and 21 are schematic views illustrating the child motion apparatus 100 respectively in a deployed and a collapsed state. Referring to FIGS. 16 and 18, the upright column 106 and the bar segment 176 are exemplary shown in the upper position above the upper surface 162B of the base 102. In this upper position, the bar segment 176 does not contact with the ramp structures 178, and can rotate above the ramp structures 178 along with the seat 104 within a full range of the swaying motion about the rotation axis Z.

Referring to FIGS. 17 and 21, when the seat 104 is lowered toward the upper surface 162B of the base 102 for collapsing the child motion apparatus 100, the bar segment 176 can move downward along with the seat 104 and come into sliding contact with one of the two ramp structures 178, which causes the bar segment 176 and the seat 104 to rotate about the rotation axis Z toward a centered position of the base 102. When the bar segment 176 is captured and locked in the space 179 between the two ramp structures 178 in a position substantially aligned with the longitudinal axis B of the base 102, the seat 104 is correspondingly in the centered position. When the seat 104 is in the centered position, the longitudinal axis S (better shown in FIG. 2) of the seat 104 is substantially aligned with the longitudinal axis B of the base 102.

When the child motion apparatus 100 is collapsed, the retaining mechanism of the ramp structures 178 thus can automatically displace and lock the seat 104 in the centered position. Since rotation of the seat 104 is prevented, transportation of the collapsed child motion apparatus 100 can be facilitated.

Referring again to FIGS. 5 and 6, the child motion apparatus 100 can further include a magnetic drive system 180 operable to drive the seat 104 to sway sideways about the rotation axis Z defined by the upright column 106. The magnetic drive system 180 can include two magnetic members 182 and 184 respectively affixed with the seat 104 and the base 102 at positions eccentrically offset from the rotation axis Z. The magnetic member 182 can be affixed with a distal end of the bar segment 176 remote from the upright column 106, and the magnetic member 184 can be affixed with the shell body 162 behind the upright column 106. The magnetic member 184 may be positioned aligned with the longitudinal axis B of the base 102 and adjacent to the moving path of the magnetic member 182. At least one of the two magnetic members 182 and 184 is an electromagnet. In one embodiment, the magnetic member 184 affixed with the base 102 can be an electromagnet, and the magnetic member 182 affixed with the seat 104 can be a magnet. In another embodiment, the two magnetic members 182 and 184 may be electromagnets. As the seat 104 sways sideways about the rotation axis Z, a magnetic force may be generated between the two magnetic members 182 and 184 when they are in proximity of each other to maintain the swaying motion of the seat 104. The swaying motion of the seat 104 can help soothing a child and substantially remain within the footprint of the base 102, which can reduce the size of the child motion apparatus 100.

Referring again to FIG. 6, the magnetic drive system 180 can further include an optical sensor 186 and an encoder 188 respectively affixed with the adjustable frame 166 and the sleeve 170. A light beam emitted by the optical sensor 186 travels through a slit 188A of the encoder 188 when it is in an aligned position with the light beam, and is blocked by the encoder 188 outside the slit 188A. Accordingly, the optical sensor 186 can detect the passage of the slit 188A of the encoder 188 so as to derive a current speed and/or amplitude of the seat 104 during the swaying motion.

Figure 22A:
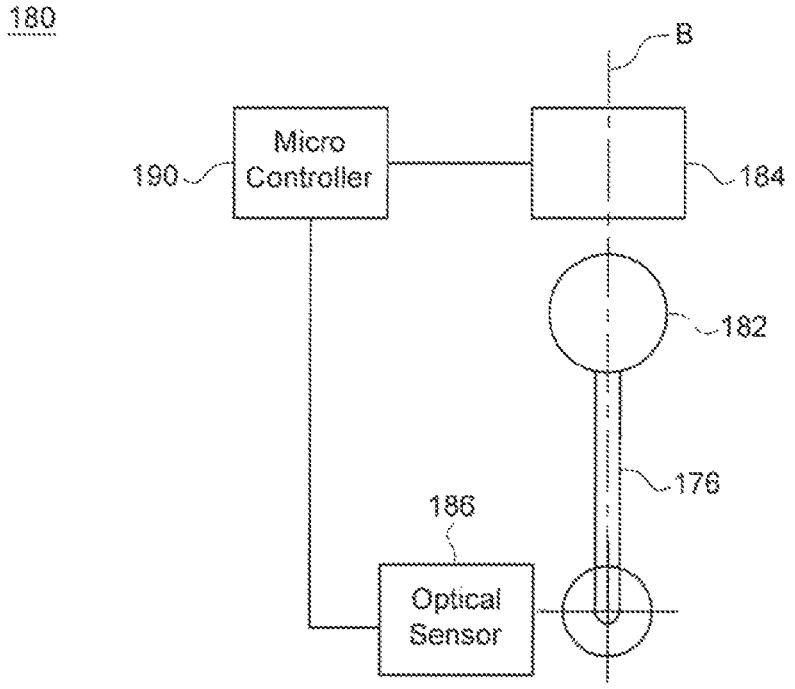
FIGS. 22A-22D are schematic views illustrating exemplary operation of a magnetic drive system implemented in the child motion apparatus.

In conjunction with FIGS. 1-6, FIGS. 22A-22D are schematic views illustrating a sequence of exemplary steps performed by the magnetic drive system 180 to drive a swaying motion of the seat 104 for soothing a child. Referring to FIG. 22A, the magnetic drive system 180 can further include a microcontroller 190 that is respectively connected with the optical sensor 186 and the magnetic member 184 affixed to the base 102 (the magnetic member 184 is an electromagnet in this embodiment). The microcontroller 190 can receive speed and/or amplitude information related to the seat 104 detected by the optical sensor 186, and output a control signal for supplying an energizing electric current to the magnetic member 184.

In FIG. 22A, the bar segment 176 is exemplary shown as being aligned with the longitudinal axis B of the base 102, which corresponds to a centered position of the seat 104 relative to the base 102 (i.e., the longitudinal axes S and B of the seat 104 and the base 102 are vertically aligned with each other). The seat 104 and the bar segment 176 can be maintained stationary in this centered position by gravity action.

Figure 22B:
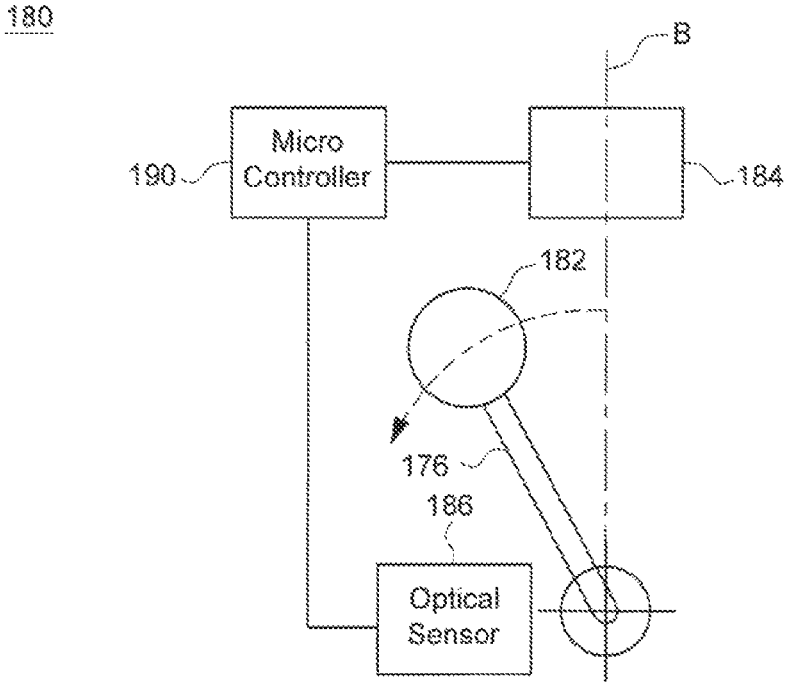

Referring to FIG. 22B, the seat 104 and the bar segment 176 can be displaced sideways (e.g., to the left side) from the centered position and then released to initiate a swaying motion. The swaying motion of the seat 104 can be performed along an arc that passes adjacent to the magnetic member 184. In one embodiment, the initial swaying displacement of the seat 104 may be made manually by a caregiver.

In another embodiment, the swaying motion of the seat 104 may be started by operation of the magnetic drive system 180. It is assumed that the seat 104 is adjacent to the centered position in an idle state before the swaying motion begins. At the beginning, the initial swaying displacement of the seat 104 may be accomplished by energizing the magnetic member 184 of the base 102 so as to produce a magnetically repulsive force applied to the magnetic member 182 of the bar segment 176, which pushes the seat 104 from the centered position to a first side. The repulsive force then is removed, and the seat 104 can sway back toward the centered position by gravity action once it reaches its farthest point. The microcontroller 190 can execute a timing program that estimates when the magnetic member 182 changes direction and begins moving toward the centered position, at which point the magnetic member 184 of the base 102 is energized so as to produce a magnetically attractive force for a predetermined time interval until the magnetic member 182 approximately reaches the predetermined centered position. As the seat 104 travels past the centered position, the magnetic member 184 of the base 102 is energized so as to produce a repulsive force to push the seat 104 away from the centered position to a second side opposite to the first side. The repulsive force then is removed, and the seat 104 sways back again toward the centered position by gravity action. The sequence of alternated repulsive and attractive forces as previously described may be repeatedly applied for a preset time interval corresponding to a self-start phase during which no measure of the speed or amplitude of the seat 104 is made. This self-start phase allows to set a sufficient amplitude in the swaying path of the seat 104.

Figure 22C:
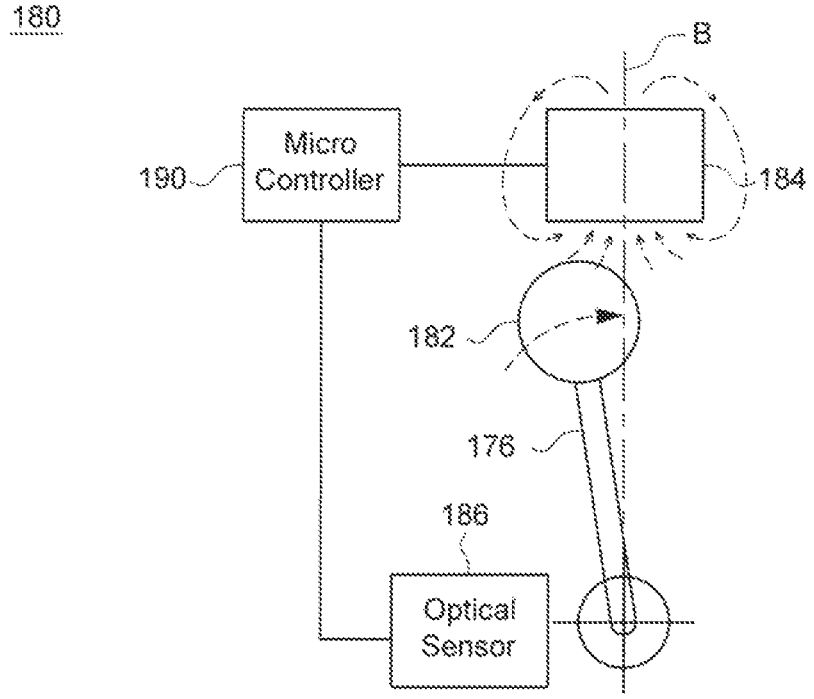

Referring to FIG. 22C, after the swaying motion of the seat 104 and the bar segment 176 is initiated, the seat 104 and the bar segment 176 can sway by themselves under gravity action toward the centered position. The magnetic drive system 180 then can enter a swaying control mode of operation for maintaining the desired swaying motion. In the swaying control mode, as the seat 104 and the bar segment 176 travel toward the predetermined centered position (e.g., from the left side as shown in FIG. 22C), the optical sensor 186 can measure the speed of the seat 104, and the microcontroller 190 can compare it against a desired speed that can be selected by a caregiver among a table of preprogrammed speed values. If the measured speed is marginally slower than the desired speed value, the magnetic member 184 can be energized to produce an magnetic field (exemplary shown with phantom lines) attracting the magnetic member 182 for a shorter time interval as the magnetic member 182 approaches the magnetic member 184. In case the measured speed is substantially slower than the desired speed value, the magnetic member 184 can be energized to attract the magnetic member 182 for a longer time interval as the magnetic member 182 approaches the magnetic member 184. If the measured speed is equal to or greater than the desired speed, it means that the seat 104 and the bar segment 176 are moving faster than desired, and the magnetic member 184 is not energized for that cycle.

Figure 22D:
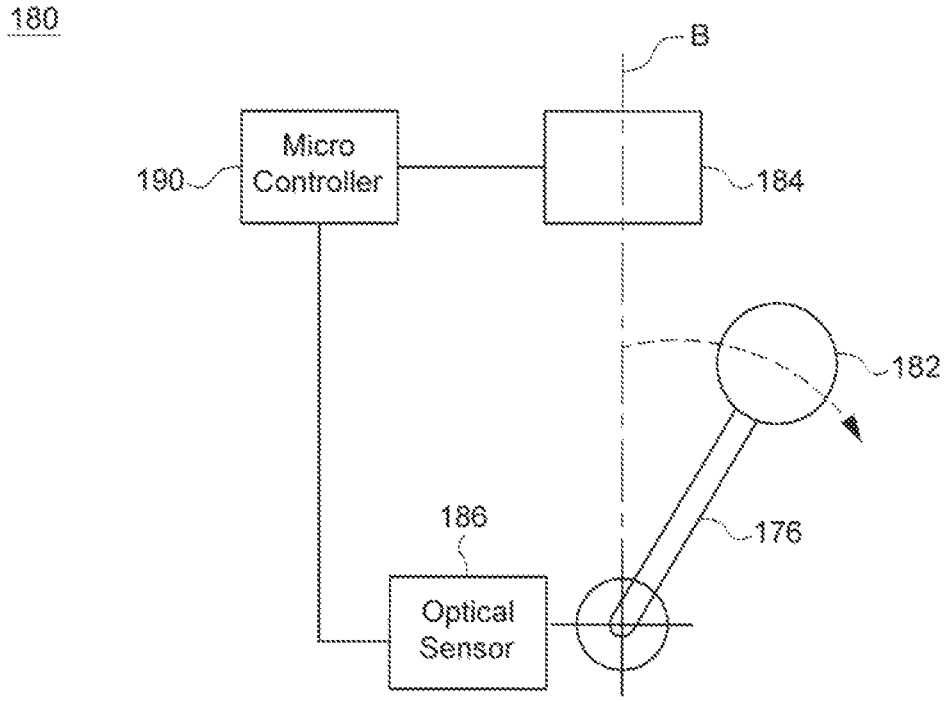

Referring to FIG. 22D, once the seat 104 and the bar segment 176 travel past the centered position, the energizing current supplied to the magnetic member 184 is stopped. Accordingly, no magnetic forces are generated between the two magnetic members 182 and 184 while the seat 104 and the bar segment 176 travel away from the centered position.

The aforementioned swaying control mode applied by the magnetic drive system 180 can be repeated for each swaying cycle of the seat 104 and the bar segment 176.

Figure 23A:
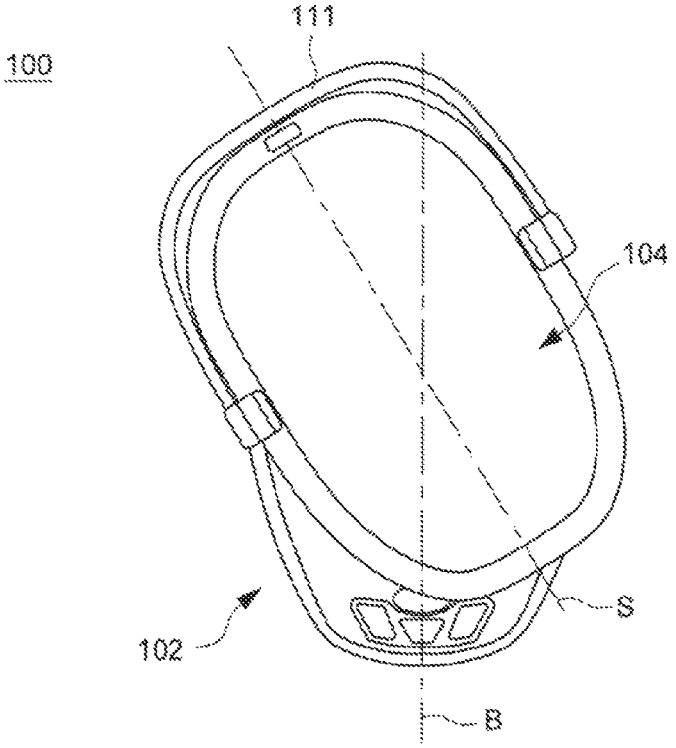
FIGS. 23A-23C are schematic views illustrating exemplary a swaying motion performed by the child motion apparatus.
Figure 23B:
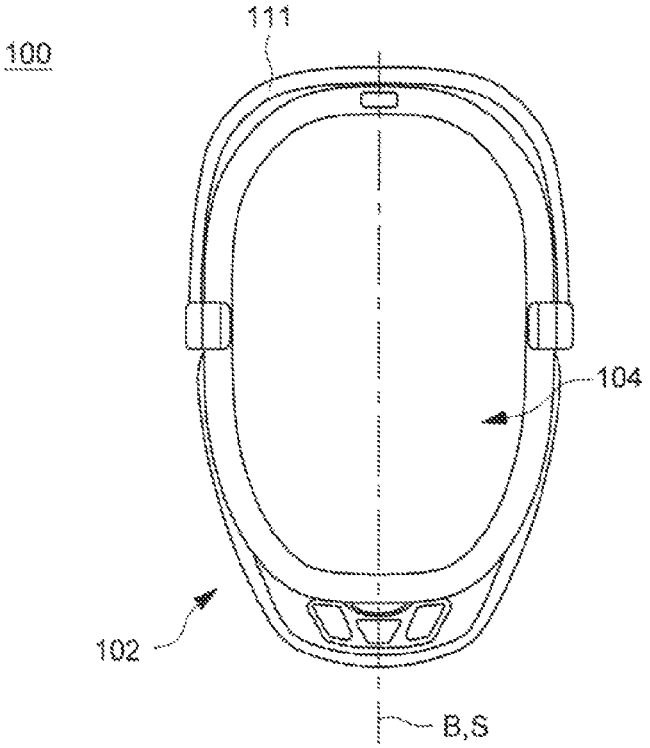
Figure 23C:
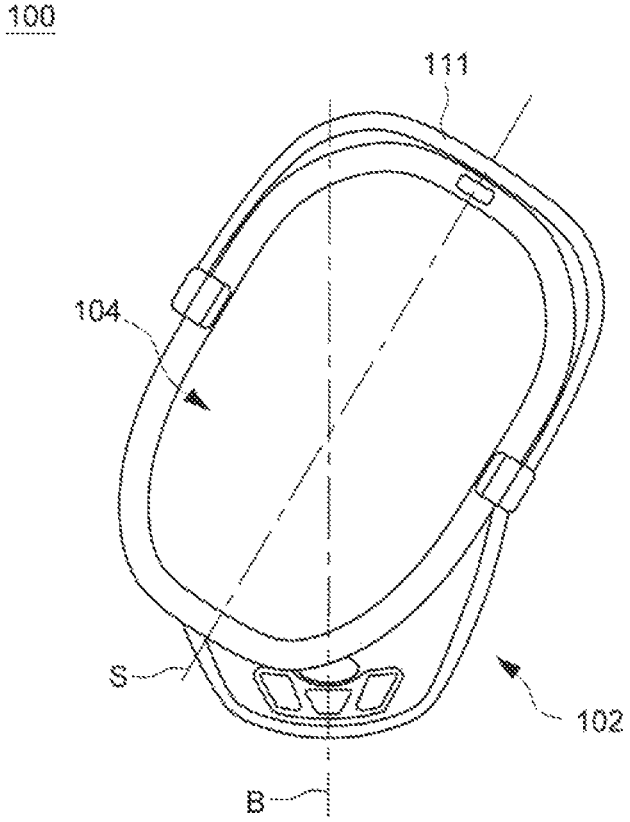

FIGS. 23A-23C are schematic views illustrating exemplary swaying motion of the seat 104 relative to the base 102 corresponding to the sequence shown in FIGS. 22B-22D. The same sequence of steps as described above may be applied each time the seat 104 and the bar segment 176 approach the centered position from the left or right side. Accordingly, the magnetic drive system 180 can operate to suitably maintain the swaying motion of the seat 104 without additional effort from a caregiver.

Figure 19:
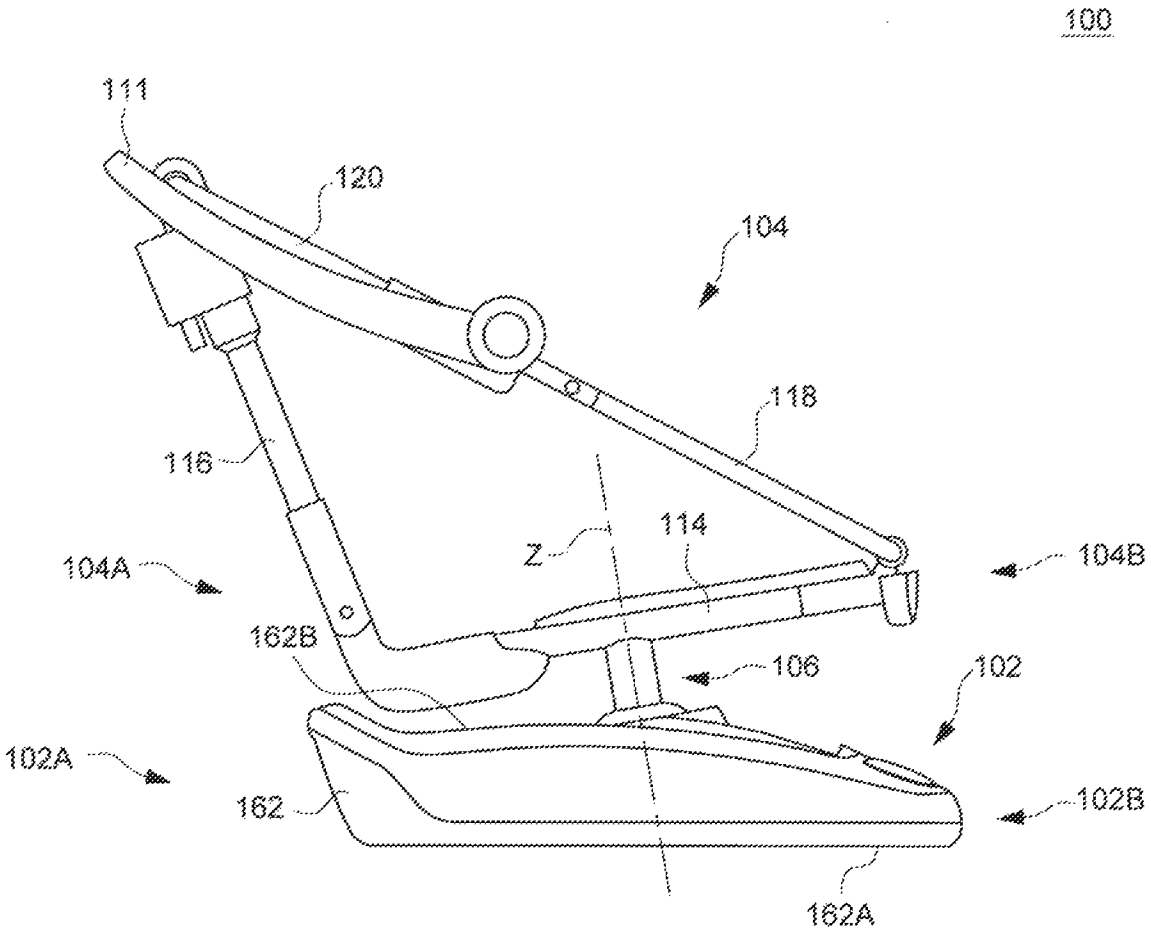
FIGS. 19-21 are schematic side views illustrating intermediate stages in the collapse of the child motion apparatus.

When it is unused, the child motion apparatus 100 can also be conveniently collapsed into a compact form. In conjunction with FIGS. 1-6, FIGS. 19-21 are schematic views illustrating intermediate stages in the collapse of the child motion apparatus 100. For collapsing the child motion apparatus 100, the release button 150 is first depressed to unlock the carrying handle 111, which is then rotated toward the surrounding frame portion 120, as shown in FIG. 19.

Figure 20:
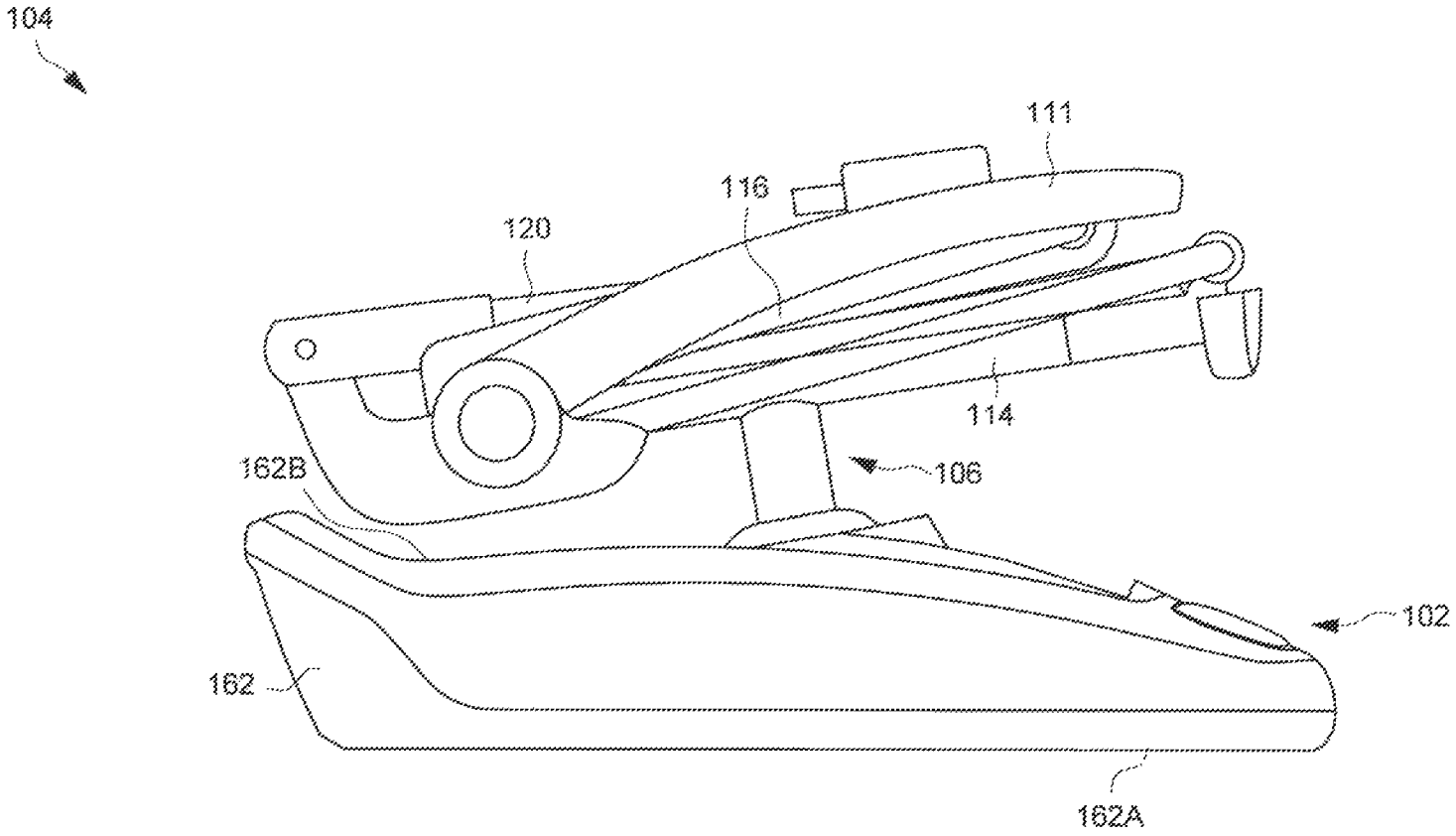

Referring to FIGS. 3 and 20, the release button 142 is then depressed to unlock the pivot hinges 122, and the surrounding frame portion 120 can be folded forward toward the surrounding frame portion 118.

Referring to FIGS. 3 and 21, the release actuator 174 at the bottom of the base 102 (better shown in FIG. 3) then can be operated to disengage the abuttal member 172 from the adjustable frame 166, which allows downward rotation of the adjustable frame 166 about the pivot axis P6. The seat 104 and the upright column 106 then can be collapsed downward toward the upper surface 162B of the base 102. As described previously with reference to FIGS. 16 and 17, this downward displacement of the seat 104 also causes the bar segment 176 to move downward and come into sliding contact with one of the ramp structures 178. This sliding contact between the bar segment 176 and the ramp structure 178 causes rotation of the bar segment 176 and the seat 104 until the bar segment 176 is captured and locked in the space 179 between the two ramp structures 178, which corresponds to the centered position of the seat 104. By having the collapsed seat 104 locked in the centered position, transportation of the child motion apparatus 100 can be facilitated.

Advantages of the structures described herein include the ability to collapse the child motion apparatus into a compact form and lock the seat of the child motion apparatus in a centered position for facilitating its transportation. Moreover, the child motion apparatus can have a magnetic drive system capable of maintaining the swaying motion of the seat for soothing a child without additional effort from the caregiver.

It is worth noting that while the embodiments described herein use a magnetic drive system to impart the swaying motion, other embodiments may use different types of driving mechanisms, such as electric motors or spring mechanisms.

Realizations of the child motion apparatus has been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A child motion apparatus comprising:

a base;

a seat arranged above the base, the seat including a bottom frame segment, a seatback frame segment, and a first and a second surrounding frame portion pivotally connected with each other, the bottom frame segment having a front and a rear end, the seatback frame segment being pivotally connected with the rear end of the bottom frame segment, the first surrounding frame portion being pivotally connected with the seatback frame segment, and the second surrounding frame portion being pivotally connected with the front end of the bottom frame segment; and an upright column disposed below the seat and pivotally supporting the seat above the base, the upright column being connected with the bottom frame segment at a location between the front end and the rear end thereof.

2. The child motion apparatus according to claim 1, further including a recline adjustment mechanism arranged adjacent to a pivot hinge connecting the seatback frame segment with the first surrounding frame portion, the recline adjustment mechanism being operable to modify an inclination angle of the seatback frame segment relative to the bottom frame segment.

3. The child motion apparatus according to claim 2, wherein the recline adjustment mechanism includes:

a housing pivotally connected with the first surrounding frame portion, the seatback support segment being assembled through the housing for sliding movement along a lengthwise axis extending along the seatback frame segment; and a latch connected with the housing, the latch being operable to block a sliding displacement of the seatback frame segment relative to the housing.

4. The child motion apparatus according to claim 1, further including a carrying handle, the first surrounding frame portion being respectively connected pivotally with the second surrounding frame portion and the carrying handle about a same pivot axis.

5. The child motion apparatus according to claim 1, wherein the upright column defines a rotation axis about which the seat is rotatable sideways, the rotation axis being tilted rearward relative to a vertical direction.

6. The child motion apparatus according to claim 5, wherein a rearward inclination angle of the rotation axis relative to the vertical direction is between about 0 and about 15 degrees.

7. The child motion apparatus according to claim 1, further including a magnetic drive system operable to drive the seat to sway sideways about a rotation axis defined by the upright column, the magnetic drive system including a first and a second magnetic member respectively affixed with the seat and the base at positions offset from the rotation axis, a magnetic force being generated between the first and second magnetic members for maintaining the swaying motion of the seat when the first and second magnetic members are in proximity of each other.

8. The child motion apparatus according to claim 7, wherein at least one of the first and second magnetic member is an electromagnet.

9. The child motion apparatus according to claim 7, wherein the base has a longitudinal axis extending centrally from a rear to a front of the base, and the second magnetic member is arranged in alignment with the longitudinal axis.

10. The child motion apparatus according to claim 7, wherein the seat is fixedly connected with a bar segment extending radially from the upright column, the first magnetic member being arranged at a distal end of the bar segment that is remote from the upright column.

11. The child motion apparatus according to claim 10, wherein the base includes at least one ramp structure and has a first longitudinal axis extending centrally from a rear to a front of the base, and the seat is vertically movable relative to the base and has a second longitudinal axis extending centrally from a rear to a front of the seat, the bar segment coming into sliding contact against the ramp structure when the seat and the bar segment are displaced downward, the sliding contact between the ramp structure and the bar segment causing the seat to rotate to a centered position where the first and second longitudinal axes are substantially aligned with each other.

12. The child motion apparatus according to claim 11, wherein the bar segment is substantially aligned with the first longitudinal axis when the seat is in the centered position.

13. The child motion apparatus according to claim 1, wherein the seat is movable vertically relative to the base, and the base includes two ramp structures configured to capture the seat in a centered position with respect to the base as the seat is lowered toward the base.

14. The child motion apparatus according to claim 13, wherein the seat is affixed with a bar segment, the bar segment being captured in a space between the two ramp structures to lock the seat in the centered position when the seat is lowered toward the base.

15. The child motion apparatus according to claim 1, wherein the base includes an adjustable frame on which the upright column is arranged, the adjustable frame being movable along with the upright column and the seat between an upper and a lower position, the seat when in the lower position being in a collapsed state, and the seat when in the upper position being deployable for use.

16. The child motion apparatus according to claim 15, wherein the base further includes a base frame, and the adjustable frame is pivotally connected with the base frame.

17. The child motion apparatus according to claim 15, wherein the base further includes an abuttal member and a release actuator connected with each other, the abuttal member being engageable with the adjustable frame for keeping the upright column and the seat in the upper position, and the release actuator being operable to disengage the abuttal member from the adjustable frame for allowing a downward displacement of the upright column and the seat from the upper position to a collapsed position.

18. The child motion apparatus according to claim 17, wherein the release actuator is accessible at an underside of the base.

19. A child motion apparatus comprising:

a base having a shell body;

a seat arranged above the shell body of the base;

a bar segment fixedly connected with the seat and disposed inside the shell body;

an upright column pivotally supporting the seat above the base, the upright column defining a rotation axis of the seat relative to the base; and a magnetic drive system operable to drive the seat and the bar segment to sway sideways about the rotation axis, the magnetic drive system including a first magnetic member affixed with the bar segment and a second magnetic member affixed with the shell body, a magnetic force being generated between the first and second magnetic members for maintaining a swaying motion of the seat when the first and second magnetic members are in proximity of each other.

20. The child motion apparatus according to claim 19, wherein the magnetic drive system is operable to alternately generate magnetically repulsive and attractive forces between the first and second magnetic members in a self-start phase for initiating the sway motion of the seat.

21. The child motion apparatus according to claim 19, wherein the magnetic drive system is operable in a swaying control mode in which a magnetically attractive force is generated between the first and second magnetic members when the first magnetic member travels toward the second magnetic member at a speed lower than a predetermined value, and no magnetic forces are generated between the first and second magnetic members when the first magnetic member travels away from the second magnetic member.

22. The child motion apparatus according to claim 19, wherein the second magnetic member is positioned in the shell body of the base behind the upright column.

23. The child motion apparatus according to claim 19, wherein the bar segment extends radially from the rotation axis.

24. The child motion apparatus according to claim 19, wherein the bar segment is centrally affixed with the seat, and the second magnetic member is centrally affixed with the base.

25. The child motion apparatus according to claim 19, wherein the base includes at least one ramp structure and has a first longitudinal axis extending centrally from the rear to the front of the base, and the seat is vertically movable relative to the base and has a second longitudinal axis extending centrally from a rear to a front of the seat, the bar segment coming into sliding contact against the ramp structure when the seat and the upright column are displaced downward, the sliding contact between the ramp structure and the bar segment causing the seat to rotate to a centered position where the first and second longitudinal axes are substantially aligned with each other.

26. The child motion apparatus according to claim 25, wherein the at least one ramp structure include two ramp structures, and the bar segment is captured in a space between the two ramp structures when the seat is lowered toward the base.

27. The child motion apparatus according to claim 25, wherein the upright column is arranged on an adjustable frame, the adjustable frame being movable with the upright column when the seat is vertically collapsed toward the base.

28. The child motion apparatus according to claim 27, wherein the base further includes an abuttal member and a release actuator connected with each other, the abuttal member being engageable with the adjustable frame for keeping the upright column and the seat in an upper position where the seat is deployable for use, and the release actuator being operable to disengage the abuttal member from the adjustable frame for allowing the seat to collapse downward toward the base.

29. The child motion apparatus according to claim 19, wherein the upright column is positioned below the seat.

30. The child motion apparatus according to claim 19, wherein the upright column includes a shaft attached with the base, and a sleeve affixed with the seat and rotatable about the shaft, the bar segment being affixed with the sleeve.

31. The child motion apparatus according to claim 19, wherein the rotation axis of the seat is inclined an angle relative to a vertical direction, and the seat is inclined rearward.

32. The child motion apparatus according to claim 31, wherein a rearward inclination angle of the rotation axis relative to the vertical direction is between about 0 and about 15 degrees.

33. A child motion apparatus comprising:

a base;

a seat arranged above the base, the seat including a bottom frame segment, a seatback frame segment and a surrounding frame, the bottom frame segment having a front and a rear end, the seatback frame segment having a lower end and an upper end, the lower end of the seatback frame segment being pivotally connected with the rear end of the bottom frame segment, the surrounding frame having a rear and a front portion opposite to each other that are respectively connected with the upper end of the seatback frame segment and the front end of the bottom frame segment; and an upright column disposed below the seat and pivotally supporting the seat above the base, the upright column being connected with the bottom frame segment at a location between the front end and the rear end thereof.

34. The child motion apparatus according to claim 33, wherein the base includes a shell body, and the seat is fixedly connected with a bar segment enclosed in the shell body, the bar segment being affixed with a first magnetic member, and the shell body being affixed with a second magnetic member, a magnetic force being generated between the first and second magnetic members for maintaining a swaying motion of the seat and the bar segment relative to the base when the first and second magnetic members are in proximity of each other.

* * * * *